US011559091B2

(12) United States Patent
Eugene et al.

(10) Patent No.: US 11,559,091 B2
(45) Date of Patent: Jan. 24, 2023

(54) ARTICLE FOR IMPROVED GRIP AND PROTECTION IN ATHLETICS

(71) Applicant: Gryppers, Inc., Raleigh, NC (US)

(72) Inventors: Jamelle Eugene, Raleigh, NC (US); DaJuan Morgan, Raleigh, NC (US)

(73) Assignee: GRYPPERS, INC., Raleigh, NC (US)

( * ) Notice: Subject to any disclaimer, the term of this patent is extended or adjusted under 35 U.S.C. 154(b) by 477 days.

(21) Appl. No.: 16/562,983

(22) Filed: Sep. 6, 2019

(65) Prior Publication Data

US 2019/0387821 A1 Dec. 26, 2019

Related U.S. Application Data

(63) Continuation-in-part of application No. 29/586,183, filed on Dec. 1, 2016, now abandoned, and a continuation-in-part of application No. 15/229,599, filed on Aug. 5, 2016, now abandoned.

(51) Int. Cl.
*A41D 19/015* (2006.01)

(52) U.S. Cl.
CPC .... *A41D 19/01558* (2013.01); *A63B 2209/00* (2013.01)

(58) Field of Classification Search
CPC ..... A41D 19/01558; A41D 19/01582; A41D 19/01564; A41D 19/01523; A41D 19/015; D10B 2501/00; D04B 1/28
USPC ..... 2/161.1, 161
See application file for complete search history.

(56) References Cited

U.S. PATENT DOCUMENTS

| | | | | |
|---|---|---|---|---|
| 2,646,796 | A | 7/1953 | Scholl | |
| 5,135,226 | A | 8/1992 | Place | |
| 5,577,272 | A | 11/1996 | Fisher | |
| 5,628,069 | A * | 5/1997 | Ebert | A41D 19/01547 2/161.1 |
| 6,092,238 | A | 7/2000 | Fierabend, Jr. | |
| 6,128,778 | A | 10/2000 | Castagneri | |
| 6,185,747 | B1 * | 2/2001 | Hughes | A41D 19/01505 2/161.6 |
| 6,374,416 | B1 | 4/2002 | Baranauskas | |
| 6,427,246 | B1 * | 8/2002 | Doi | A41D 19/01588 2/161.1 |
| 6,839,905 | B1 | 1/2005 | Bruder et al. | |
| 7,012,169 | B2 | 3/2006 | McDevitt et al. | |
| D675,382 | S | 1/2013 | Eugene et al. | |
| 8,425,339 | B2 | 4/2013 | Basden | |
| 8,443,462 | B1 | 5/2013 | Eugene | |
| 8,539,614 | B2 | 9/2013 | Cote | |
| 9,604,121 | B2 | 3/2017 | Staton | |
| 9,839,243 | B2 | 12/2017 | Wulf | |
| 9,858,907 | B2 | 1/2018 | Racine et al. | |
| 10,136,686 | B2 | 11/2018 | Savides | |

(Continued)

*Primary Examiner* — Alissa L Hoey
*Assistant Examiner* — Catherine M Ferreira
(74) *Attorney, Agent, or Firm* — Neo IP

(57) ABSTRACT

Sleeves for improving performance and control are disclosed. The sleeves are constructed for use on the fingers, wherein each sleeve is constructed in some embodiments with grip zones that match areas of the finger to ensure improved grip while maintaining flexibility, compression, protection, and material durability. Each grip zone is positioned to ensure that fingers are able to naturally bend without impeding grip performance. A spine on a rear of the sleeve ensures material durability, limits over extension, and provides padding and protection.

20 Claims, 19 Drawing Sheets

(56) References Cited

U.S. PATENT DOCUMENTS

| | | | | |
|---|---|---|---|---|
| 10,219,555 | B2 | 3/2019 | Ramirez | |
| 10,231,499 | B2 | 3/2019 | Lefrancois, Jr. | |
| 2003/0119632 | A1 | 6/2003 | Archuleta | |
| 2004/0045071 | A1 | 3/2004 | Robins | |
| 2006/0130212 | A1* | 6/2006 | Kishihara | A41D 19/0055 2/167 |
| 2006/0242780 | A1 | 11/2006 | Yang et al. | |
| 2009/0139007 | A1* | 6/2009 | Bevier | A63B 71/148 2/161.1 |
| 2009/0271913 | A1* | 11/2009 | Fisher | A41D 19/01588 2/163 |
| 2010/0024095 | A1* | 2/2010 | Gellis | B29C 45/14 2/167 |
| 2012/0005805 | A1* | 1/2012 | Bevier | A41D 19/0006 2/161.1 |
| 2012/0019464 | A1 | 1/2012 | DiDato | |
| 2012/0030855 | A1 | 2/2012 | Clark | |
| 2012/0052968 | A1 | 3/2012 | Basden | |
| 2012/0151652 | A1 | 6/2012 | Tulloch | |
| 2012/0222186 | A1 | 9/2012 | Vena | |
| 2012/0297515 | A1 | 11/2012 | Mysyk | |
| 2013/0060183 | A1* | 3/2013 | Ramirez | A63B 71/14 602/48 |
| 2013/0067635 | A1* | 3/2013 | Lin | A41D 19/00 2/167 |
| 2013/0111642 | A1* | 5/2013 | Eugene | A63B 71/148 2/21 |
| 2013/0167282 | A1 | 7/2013 | Ramirez | |
| 2013/0198920 | A1 | 8/2013 | Wittman | |
| 2013/0310202 | A1 | 11/2013 | Griffee et al. | |
| 2014/0091006 | A1 | 4/2014 | Fogel | |
| 2014/0259283 | A1* | 9/2014 | Govindasamy | A41D 19/0082 2/161.7 |
| 2014/0304886 | A1 | 10/2014 | Eugene | |
| 2015/0077347 | A1 | 3/2015 | O'Green | |
| 2015/0251076 | A1 | 9/2015 | Staton | |
| 2016/0074740 | A1 | 3/2016 | Sekhon | |
| 2016/0120707 | A1 | 5/2016 | Ramirez | |
| 2016/0143772 | A1 | 5/2016 | McLain | |
| 2016/0184042 | A1 | 6/2016 | Buhari et al. | |
| 2016/0227978 | A1 | 8/2016 | Shaykova | |
| 2016/0249697 | A1 | 9/2016 | Racine et al. | |
| 2016/0303462 | A1 | 10/2016 | Ramirez | |
| 2016/0375343 | A1 | 12/2016 | Woodhead | |
| 2017/0055601 | A1 | 3/2017 | Ramirez | |
| 2017/0196279 | A1 | 7/2017 | Staton | |
| 2017/0238632 | A1 | 8/2017 | Aprile | |
| 2017/0239553 | A1 | 8/2017 | Kowalsky | |
| 2017/0296371 | A1 | 10/2017 | Bernardino et al. | |
| 2017/0319935 | A1 | 11/2017 | Griffee et al. | |
| 2017/0360120 | A9 | 12/2017 | Ramirez | |
| 2018/0035735 | A1 | 2/2018 | Eugene et al. | |
| 2018/0103733 | A1 | 4/2018 | Trahern | |
| 2018/0240354 | A1 | 8/2018 | Carrick | |
| 2019/0091549 | A1 | 3/2019 | Szilagy et al. | |
| 2019/0110536 | A1 | 4/2019 | Cutkosky et al. | |
| 2019/0133217 | A1 | 5/2019 | Ramirez | |

* cited by examiner

ARTICLE FOR IMPROVED GRIP AND PROTECTION IN ATHLETICS

CROSS REFERENCES TO RELATED APPLICATIONS

This application is related to and claims priority from the following US patents and patent applications. This application is a continuation-in-part of U.S. patent application Ser. No. 15/229,599, filed Aug. 5, 2016, and is a continuation-in-part of U.S. Design Pat. application Ser. No. 29/586,183, filed Dec. 1, 2016, each of which is incorporated herein by reference in its entirety.

BACKGROUND OF THE INVENTION

1. Field of the Invention

The present invention relates to objects for improving hand-based control in athletic events, and more specifically to textile items worn on the fingers to improve grip, comfort, compression, and protection.

2. Description of the Prior Art

It is generally known in the prior art to provide gloves for use in athletic competitions and physical activities, such as football, baseball, or weight lifting. These gloves provide both protection and increased traction and grip over bare hands. The gloves are often coated in a grip-enhancing material that provides an increased coefficient of friction during use, such as silicone.

Prior art patent documents include the following:

U.S. Pat. No. 10,219,555 for Finger Cots by inventor Ramirez, filed Oct. 31, 2014, and issued Mar. 5, 2019, is directed to: According to the various features, characteristics and embodiments of the present invention which will become apparent as the description thereof proceeds, the present invention provides reusable grip enhancing tubular members for the arm area, in particular sports sleeves for the arm and forearm, and reusable grip enhancing tubular members for the hand, in particular sports finger cots for the hand, and the uses thereof, and methods thereof, intended to increase the performance in arm and/or hand task activities.

US Patent Publication No. 20170296371 for Finger Sleeve by inventor Bernadino, et al., filed Apr. 13, 2016, and published Oct. 19, 2017 is directed to: Disclosed herein is a finger sleeve support apparatus configured to restrain relative movement between two fingers on the hand of a wearer such that protection is afforded to the restrained fingers in certain types of activities.

U.S. Pat. No. 9,604,121 for Hand-Worn Article With An Anti-Slip Surface by inventor Staton, filed Nov. 11, 2014, and issued Mar. 28, 2017 is directed to: Provided is a finger sleeve for enhancing a grip on objects to be held by a hand. The finger sleeve includes a band of a flexible material forming a cylindrical passage through which a finger of the hand is to extend. A strap is coupled to the band, and is adjustable between an open state in which the finger sleeve is to be placed onto the finger and a closed state in which the strap interferes with removal of the finger sleeve from the finger. An anti-slip surface is provided to a palm-side of the band, and includes a grip enhancing material that improves a grip on the objects to be held in the hand while wearing the finger sleeve relative to the grip on the objects to be held in the hand without the finger sleeve.

US Patent Publication No. 20040045071 for Finger Grip Aid by inventor Robins, filed Aug. 28, 2003, and published Mar. 11, 2004, is directed to: The invention provides a finger grip aid for use while holding equipment. The aid is worn on one or more fingers like a sleeve, where it compresses the finger except at an opening over the second knuckle. In one embodiment, the finger grip aid fits over the entire finger, and in a second embodiment the finger grip aid fits over the finger from the base to a position between the first and second knuckles. The inventive finger grip is particularly useful for gripping devices having elongated handles like golf clubs, or for holding hard to grip items, such as balls and drinking glasses.

US Patent Publication No. 20120151652 for Finger Jacket by inventor Tulloch, filed Dec. 13, 2011, and published Jun. 21, 2012, is directed to: Finger jackets have an improved fit for use in conjunction with various sports, athletic and special use activities. Each finger jacket has a palmar face portion and a back portion joined together to fit each human finger and adapted to fit various sizes thereof. The back portion is formed of a stretchable breathable material. The palmar face portion of each finger jacket is made of a sheet of anti-slip, grip enhancing material. Fourchettes may be connected between the palmar and back portions. Fasteners such as zippers and hook and pile fasteners may be employed.

US Patent Publication No. 20120297515 for Golf Finger Sleeves by inventor Mysyk, filed Apr. 27, 2012, and published Nov. 29, 2012, is directed to: A protective device for a wearer's digit features a flexible sleeve wearable with a distal end of the digit projecting out from the tubular sleeve and the wearer's palm unobstructed by the sleeve. The tubular sleeve has a dorsal face defined by a multi-way stretchable material to be worn on a dorsum side of the digit, and a palmar face defined by a second less stretchable material to be worn on a palm side of the digit. Each end of the tubular sleeve is shaped to form an inwardly curved end of the palmar face that curves inwardly along the axis toward a centerline of the palmar face from opposite sides thereof. This beveled configuration of the sleeve ends avoids bunching of material in joint crevices. In longer sleeves, the first material spans uninterruptedly over a full length of the sleeve to fully cover a joint of the digit.

U.S. Pat. No. 7,012,169 for Disposable Finger Sleeve for Appendages by inventor McDevitt, filed Apr. 4, 2001, and issued Mar. 14, 2006, is directed to: A device that can be used to treat appendage ailments is provided. The device, or appendage sleeve, can be used for wounds, cuts, and blisters, as well as joint related ailments, such as arthritis and carpal tunnel syndrome. In some instances, the appendage sleeve can at least partially made from an elastomeric material, such as an elastomeric nonwoven, so that the sleeve can more aptly fit onto a finger or toe. Furthermore, the sleeve can also possess a barrier that is liquid impermeable, but vapor permeable so that the finger or toe of a user is more comfortable. Various additives can be applied to the sleeve to aid for therapeutic purposes.

U.S. Pat. No. 7,552,501 for Finger Wipe with Improved Seam Structure by inventor Yang, filed Apr. 29, 2005, and issued Jun. 30, 2009, is directed to: A finger cover, such as a finger wipe that can fit onto a human finger, is provided with an improved seam structure. The cover includes a pocket member having an open end for the insertion of a finger. The pocket member is formed by a first panel attached to a second panel along a flush outwardly facing circumferential edge seam. The seam is less than about 1 millimeter (mm) in width and about 1 mm in height.

Additional reinforcing weld points may be provided at various locations along the seam.

SUMMARY OF THE INVENTION

The present invention relates to sleeves for the finger that provide improved grip, protection, and compression.

It is an object of this invention to provide a sleeve with improved control, including improved grip, comfort, protection, and durability over prior art. Particularly, the present invention provides separated sleeves for individual thumbs and fingers which advantageously allow for users to target specific areas on the hand for grip, protection, and compression. The sleeves provide further durability over traditional articles, including traditional performance gloves, as the unit design of individual sleeves, the reinforcing spine, and other advantageous elements reduce stress points that often lead to tearing of the article, overextension of the fingers, or other problems that harm the product's efficacy.

Advantageously, in one embodiment, the present invention includes multiple sleeves with multiple grip zones, wherein each sleeve is sized to an individual finger, and wherein the grip zones are separated corresponding to phalanges regions of the corresponding finger or thumb. The sleeve further comprises a rear spine, wherein the rear spine provides protection, flexibility, and durability through a textile construction that adds additional material to a rear of the sleeve. The material is positioned such that the spine allows for free movement of a bended finger without over tensioning the article. Additionally, internal grip zones provide for stability of the sleeve during use, such that the grip zones maintain a desired position on the fingers or thumbs without sliding or rotating.

In one embodiment, the present invention includes a sleeve for improved grip and performance, comprising: a textile base layer, at least two grip zones, and a spine; wherein the textile base layer is seamless; wherein a coefficient of friction of the at least two grip zones is greater than a coefficient of friction of the textile base layer; wherein the at least two grip zones are separated such that at least one textile region of the sleeve between the at least two grip zones is less rigid than the at least two grip zones to promote bending at the at least one textile region of the sleeve; and wherein the spine is segmented to provide flexibility to the sleeve.

In another embodiment, the present invention includes a sleeve for improved grip and performance, comprising: a textile base layer, at least one grip zone, and a spine; wherein the textile base layer is seamless; wherein a coefficient of friction of the at least one grip zone is greater than a coefficient of friction of the textile base layer; wherein the at least one grip zone is integrated into the textile base layer; wherein the at least one grip zone is polygonal in shape; and wherein the spine is segmented to provide flexibility to the sleeve.

In yet another embodiment, the present invention includes a sleeve for improved grip and performance, comprising: a textile base layer and at least two grip zones; wherein the textile base layer is cylindrical; wherein a coefficient of friction of the at least two grip zones is greater than a coefficient of friction of the textile base layer; wherein the at least two grip zones are integrated into the textile base layer; and wherein the at least two grip zones are polygonal in shape.

These and other aspects of the present invention will become apparent to those skilled in the art after a reading of the following description of the preferred embodiment when considered with the drawings, as they support the claimed invention.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
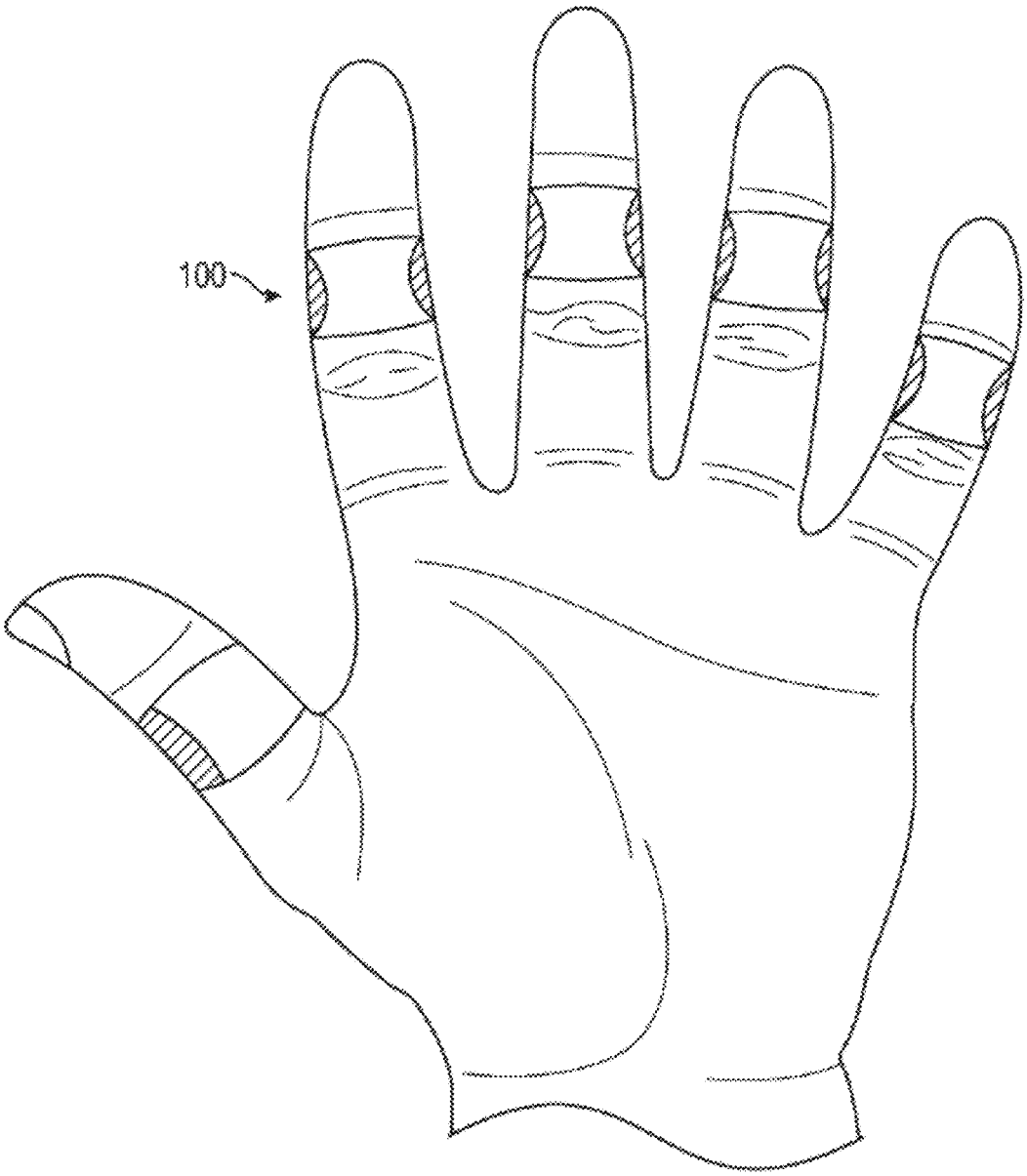
FIG. 1 is a view of the cylindrical compression base layer material worn on the fingers consistent with certain embodiments of the present invention.

The present invention is generally directed to a sleeve that provides improved control, including improved grip, comfort, protection, and durability over prior art. Particularly, the present invention provides separated sleeves for individual thumbs and fingers which advantageously allows for athletes and other individuals to target specific areas on the hand for control, grip, protection, and compression. The sleeves provide further durability over other articles, including traditional performance gloves, as the unit design of individual sleeves, the reinforcing spine, and other advantageous elements reduce stress points that often lead to tearing of the article, overextension of the fingers, or other problems that harm the product's efficacy.

Individuals engaged in activities having equipment that must come into contact with the hands must periodically attempt to grasp an item, such as a ball, racket, glove, wire rim, or other equipment associated with the athletic endeavor with their hands. In many activities, some items of equipment are moving very quickly, and in others it is the individual whose hands are moving quickly when coming into contact with an item of game equipment. Consequently, considerable impact forces are often imposed on the hands of an individual as they come into contact with the game equipment. Also, a ball or other item may be spinning as well as moving quickly, which further complicates the action of retaining the item in the individual's grasp once the item has come into contact with the hands.

In the game of football for example, a ball may be thrown a considerable distance at considerable speed, in the game of basketball, a ball is thrown with great force and players hands may come into contact with the wire rim of a basketball goal, and, in the game of Lacrosse, balls impact a racquet with great force, transmitting that force to the hands of the athlete that grip the racquet, causing grip issues. Additional examples of forceful impacts on an individual's hands from items of sports equipment may be found in baseball, tennis, and other sports, although these examples should in no way be considered limiting. Players may attempt to come into contact with the game equipment, such as a ball, while running, which further complicates the issue of establishing and maintaining a grip on the item to be controlled or used.

In one embodiment, the present invention includes a sleeve for improved grip and performance, comprising: a textile base layer, at least two grip zones, and a spine; wherein the textile base layer is seamless; wherein a coefficient of friction of the at least two grip zones is greater than a coefficient of friction of the textile base layer; wherein the at least two grip zones are separated such that at least one textile region of the sleeve between the at least two grip zones is less rigid than the at least two grip zones to promote bending at the at least one textile region of the sleeve; and wherein the spine is segmented to provide flexibility to the sleeve.

In another embodiment, the present invention includes a sleeve for improved grip and performance, comprising: a textile base layer, at least one grip zone, and a spine; wherein the textile base layer is seamless; wherein a coefficient of friction of the at least one grip zone is greater than a coefficient of friction of the textile base layer; wherein the at least one grip zone is integrated into the textile base layer; wherein the at least one grip zone is polygonal in shape; and wherein the spine is segmented to provide flexibility to the sleeve.

In yet another embodiment, the present invention includes a sleeve for improved grip and performance, comprising: a textile base layer and at least two grip zones; wherein the textile base layer is cylindrical; wherein a coefficient of friction of the at least two grip zones is greater than a coefficient of friction of the textile base layer; wherein the at least two grip zones are integrated into the textile base layer; and wherein the at least two grip zones are polygonal in shape.

None of the prior art discloses individual sleeves that provide a combination of compression, protection, and grip enhancement provided by the sleeves of the present invention. While many athletes, such as receivers playing football, use full-hand gloves with a high coefficient of friction, these often tear, reduce dexterity of the fingertips, or are overly restrictive compared to the natural movement of a player's hand and fingers. Embodiments of the present invention include advantageous positioning and integration of grip elements, structural support via a spine, and compression that ensure improved athletic performance.

In one embodiment, the present invention includes a sleeve for improving athletic control, including grip, compression, and protection. The sleeve is constructed for use in a variety of sports, including football, basketball, baseball, golf, climbing, and surface water activities (e.g., canoeing, kayaking, and rafting). In another embodiment, the present invention provides a sleeve for improving control, including grip, compression, and protection in non-athletic applications, such as construction, heavy lifting jobs, and driving. Particularly, the sleeve provides grip enhancement zones and are constructed for use on a single finger. In contrast to traditional grip mechanisms, such as full gloves constructed from grip-enhancing materials, the present invention provides separated articles, which allow for additional freedom of movement and adjustability. Further, the articles provide additional support and flexibility via sectionalized grip elements, wherein the grip elements are positioned in a manner that both allow for comfortable range of motion of finger joints and provide efficient contact with a gripped object.

In a non-limiting embodiment, athletes, especially professional athletes, work in a complex, dynamic environment where items of sports equipment are routinely moving at velocities that not only may impart significant force on the hands of an athlete as they attempt to capture the item, but also may be difficult to capture in the first place due to the variations in vectors between the hands of the athlete and the item to be captured or gripped by the hands. However, athletes are only one group of individuals to whom grip enhancement and protection are important. Individuals who make a living grasping and gripping moving objects, such as workers in industrial settings who must select, grab, and remove substandard items from a moving assembly line are equally interested in making sure that a grip is not only effective, but also that grasping an item will not cause damage to hands at the moment of contact.

Constituent materials of each layer include, in one embodiment, for example, a woven or unwoven fabric composed of any of a plurality of yarns, threads, or unwoven materials. The fabric is, in one embodiment, air permeable, thereby enabling each layer of the apparatus to "breathe", or to dissipate perspiration from the skin of a user through layers of the apparatus to ambient air. The fabric layers of the apparatus in a further embodiment comprise artificial fibers such as nylon, rayon, polyester, and others, or natural fibers such as cotton, wool, linen, or still other types of natural and synthetic fibers, and fabrics that are blends and combinations of these fibers. The selected fibers are resistant to deterioration by exposure to perspiration, or sweat resistant.

A compression base layer includes, in one embodiment, thermal reactive or thermal reflective yarns that contain antimicrobial properties and infrared reflective technology to create one or more layers of compression base layer materials. These yarns and the compression action of these materials when woven into cloth-like coverings help stabilize finger ligaments, increase circulation, wick sweat, prevent microbial growth, increase grip strength, and return energy back to the cells of the user's skin. In one embodiment, the thermal reflective material reflects heat from a user's fingers and/or retains the heat from a user's fingers. In a further embodiment, the sleeve and/or an internal grip zone or internal pod includes a heating element, such as a chemically activated heating material. The compression base layer material in some embodiments includes a gripping agent to create the desired elasticity and compression within the textile material. The compression base layer material adds additional support to the finger ligaments to help stabilize them and reduce the likelihood of an injury and may aid in the recovery of an already injured finger that may occur as the result of an impact or improperly gripping an item. When formed into a material layer, the compression base layer is seamless so there are no weak or uneven areas.

The present invention provides, in one embodiment, an apparel apparatus having a compression base layer that is worn on the hands, which addresses those issues which pertain to activities in which grip enhancement, protection and physical protection of the hands are important. The apparel portion further includes cylindrical elements composed of at least one compression base layer material and one or more performance material layers having a cross section consistent with the cross section of a finger or one or more portions of a hand. The compression base layer, in some embodiments, is complemented by additional layered external structure(s) that are performance layers placed in contact with the compression base layer. The compression base layer and any added performance layers are further operable to be combined to form a single structure placed in contact with the fingers, thumb, or other portions of the hand of the user. The apparel portion in some embodiments is non-cylindrical in cross-section but instead are substantially contoured to be placed upon one or more portions of the hand, where the compression base layer and performance layers combine to provide grip enhancement, impact resistance, shock absorption and/or other pre-determined functions to the entirety of a finger, thumb, or other portion of the hand, or to sections of the finger, thumb, or other portion of the hand.

These performance layers in one embodiment are composed of materials that may improve frictional characteristics to enhance the grip of the hands through added friction, tackiness, or adhesion capability, materials to aid in shock absorption, materials to aid in impact resistance, materials having anti-microbial properties, materials having an embedded Bluetooth, rfi, or other near-field communication capability, and/or materials aiding in energy absorption and reflection back to the hands of the user. The performance layers are placed in contact in an overlayment construction so as to combine the functions of each performance layer to provide for one or more of the functions as previously described in a single apparatus. In this manner, each performance layer adds a separate performance characteristic such that the completed apparatus may have differing characteristics in accordance with the performance layers chosen to be placed in contact with one another and the entire performance layer construct overlain on the compression base layer. It should be apparent that the compression base layer, in one embodiment, overlay each other, and are connected to any additional performance layer or combination of performance layers to provide for multiple protection and/or grip enhancement purposes. The performance layers assists in gripping or handling a moving object without impacting grip strength and dexterity of the hands.

The combination of the compression base layer and performance layers that form the apparel apparatus in one embodiment extends the full length of the finger, or only along a more limited extent of the finger, or cover a side, back or palm portion of the hand. Finger tips are either exposed or covered by the combined apparel apparatus portions having a cylindrical cross section. Additional apparel portions are operable to be configured to encircle a hand portion, attach to other portions of the hand, such as the palm or back of the hand, or be built into another garment for wear during work or sports activities without negatively impacting the grip or dexterity of the hands of the user. Additionally, the apparel apparatus portions, in one embodiment, are used in the absence of or with conventional gloves or other hand coverings, including plaster casts which may be provided for medical purposes.

In an additional embodiment, the compression base layer is contoured and designed to fit around and/or adhere to the fingers, sides, back, or palms of the hands of the user. As stated previously, the compression base layer designed to protect the fingers in one embodiment consists of one or more cylinders that cover the entire length of the fingers or thumb, or any portion of the finger, either covering or leaving the fingertips uncovered, when worn. The cylindrical finger portions, in one embodiment, have sections upon which additional performance layers of protective and/or grip enhancement materials are installed in structural contact with the cylindrical finger portions. Additionally, an internal gripping agent, and energy capture capability and/or an energy reflection capability is built into the structure of the material of which the compression base layer is constructed. The combined apparel apparatus, consisting of the compression base layer and all performance layers, in one embodiment is fashioned to fit other portions of the hand including the palm, the back, or sides of the cylindrical finger portions, or any combination of these surfaces.

Referring now to the drawings in general, the illustrations are for the purpose of describing one or more preferred embodiments of the invention and are not intended to limit the invention thereto.

Turning now to FIG. 1, this figure presents a view of the of the cylindrical compression base layer material worn on the fingers consistent with certain embodiments of the present invention. In an exemplary embodiment, there is shown an apparel apparatus 100 for the fingers and thumb of a wearer. The apparel apparatus 100 further comprises a compression base layer configured in a cylindrical, flat, or other contoured shape. Each contoured, shaped portion may share characteristics of the compression base layer.

The cylindrical shaped portion is dimensioned and configured to be worn on a finger or thumb of the wearer. The cylindrical shaped portion further comprises a compression base layer permitting slight to moderate constriction having, in one embodiment, an open proximal end and a closed distal end, and an external surface portion comprising a multi-layer component consisting of performance layers consisting of one or more materials having impact resistance, shock absorption, adhesion, moisture wicking, and/or anti-microbial as well as other characteristics such as the inclusion of Bluetooth, radio frequency (rfi) tags, or any other near field communication capability tags or circuitry. The multi-layer performance layer component in one embodiment covers less than the full extent of the external surface of the cylindrical shaped compression base layer portion, leaving one or more zones which may be devoid of the multi-layered performance layer portion.

The cylindrical shaped compression base layer portion in one embodiment does not fully encircle any one finger or the thumb along at least part of the length of the finger or thumb, but does not necessarily include a circular cross section, since the material is fairly pliable and in one embodiment does not maintain any one cross sectional configuration to the exclusion of any other, but conforms instead to a wearer's hand.

The constituent material of the cylindrical shaped compression base layer portion in one example is a woven or unwoven fabric having compression characteristics and which is air permeable, thereby enabling the apparel apparatus to "breathe", or to dissipate perspiration from the skin through the cylindrical shaped portion to ambient air. In additional exemplary embodiments, the constituent compression base layer material further includes energy reflection and energy capture capabilities to assist in capturing any energy emitted by a user's hands, either through movement of the user's hands or generated as a result of normal body heating functions. This compression base layer constituent material further comprises artificial fibers in one embodiment such as nylon, rayon, polyester, and others, or a natural fiber such as cotton, or still other types of natural and synthetic fibers, and blends or combinations of these fibers. The selected fibers, in one embodiment, are resistant to deterioration by exposure to perspiration, and in one embodiment are sweat wicking.

Figure 2:
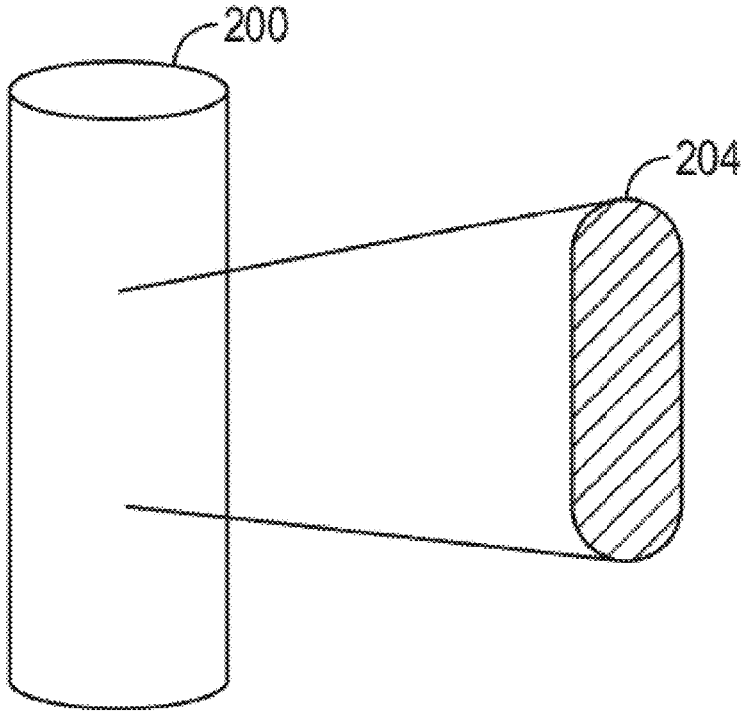
FIG. 2 is a view of the compression base layer and one additional performance layer consistent with certain embodiments of the present invention.

Turning now to FIG. 2, this figure presents a view of the compression base layer and one additional performance layer of the exemplary apparel apparatus consistent with certain embodiments of the present invention. In an exemplary embodiment, the apparel apparatus presents the compression base layer 200 that is formed in a cylindrical cross-section for placement on the finger or thumb of a user. In this exemplary embodiment, the compression base layer 200 provides additional support to finger ligaments of a user to help stabilize them and reduce the likelihood of an injury or to aid in the recovery of an already injured finger. The compression base layer 200 is, in one embodiment, sized to cover the entire length of a finger or thumb, including the end or tip of the finger or thumb, or may be sized to cover a portion of a finger or a thumb. The functional capability of the compression base layer 200 is, in one embodiment, enhanced by the addition of a performance layer 204 that provides for at least one of grip enhancement, shock absorption, impact resistance, microbial protection, moisture wicking, or additional functions. The performance layer 204 is further attached to the structure of the compression base layer 200 as a separable structure, or in one embodiment, is integrated into the compression base layer 200 as an integral portion of the combined compression base layer 200 and performance layer 204.

Figure 3:
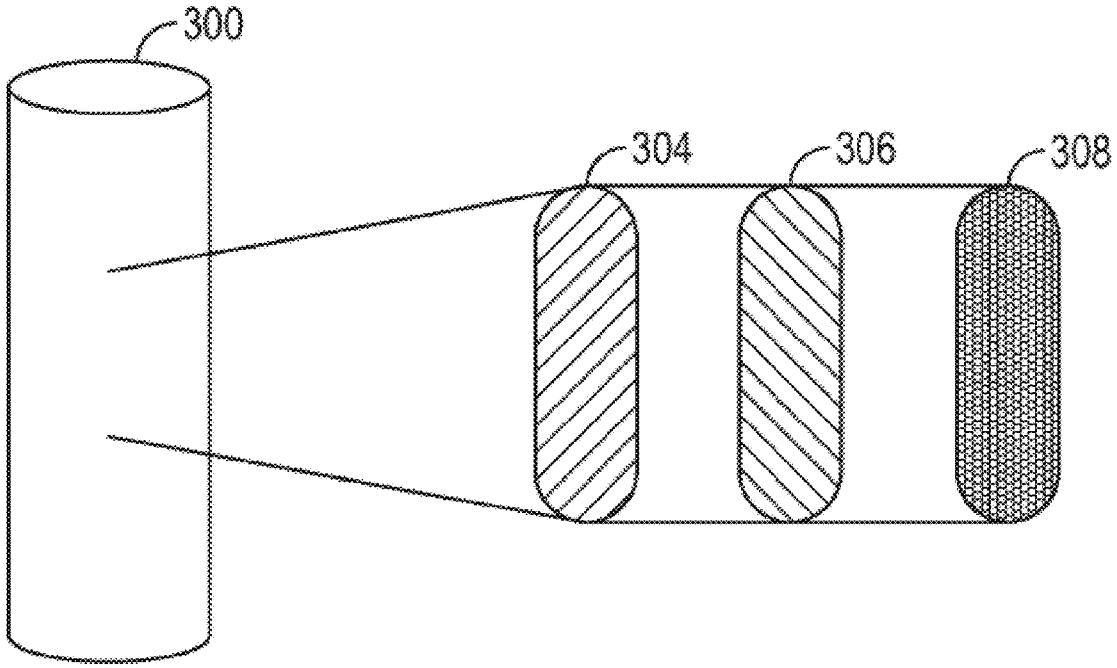
FIG. 3 is a view of the compression base layer and up to 3 additional performance layers consistent with certain embodiments of the present invention.

Turning now to FIG. 3, this figure presents a view of the compression base layer and additional performance layers consistent with certain embodiments of the present invention. In an exemplary embodiment, a compression base layer 300 is presented that has a substantially cylindrical cross section and is sized to permit a user to place the compression base layer 300 in contact with a finger or thumb such that the finger or thumb is inside the compression base layer 300 and the finger or thumb is entirely encircled by the compression base layer 300. The length of the compression base layer 300 is variable and in one embodiment is of a sufficient length to enclose any portion of the finger or thumb, and further includes an open proximate end and a closed distal end such that the tip of the finger or thumb is entirely enclosed by the compression base layer 300 and the base of the finger or thumb extends from the proximate end of the compression base layer 300. In this non-limiting example, the compression base layer 300 is formed as a closed cylinder.

In association with the compression base layer 300, in one embodiment, one or more performance layers (304, 306, 308) can be attached to, or constructed in association with, the compression base layer 300. In a non-limiting example, a performance layer 304 is constructed of materials that enhance the impact resistance of the combination of the performance layer 304 and the compression base layer 300. Additionally, a performance layer 306 that is constructed of materials that may improve shock absorption, and a performance layer constructed of materials that enhance grip 308 is placed into contact such that all three layers are attached to, or are constructed in association with, the compression base layer 300. Additional performance layers are, in one embodiment, included, such as a performance layer that assists in wicking moisture from the compression base layer 300 to the outside air, or additional functions that improve performance, grip, compression, or control. The performance layers (304, 306, 308) are, in one embodiment, attached to or constructed in association with one or more compression base layer 300 forms so as to protect fingers, thumbs, palms, sides, and the backs of a user's hands when worn by a user.

Figure 4A:
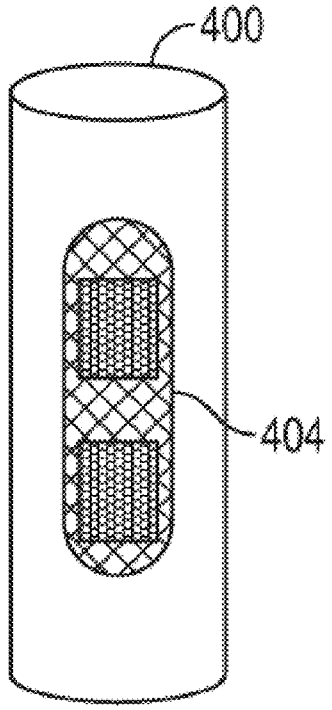
FIG. 4A is a view of the compression base layer overlain with up to 3 additional performance layers consistent with certain embodiments of the present invention.

Turning now to FIG. 4A, this figure presents a view of the compression base layer overlain with up to 3 additional performance layers consistent with certain embodiments of the present invention. In an exemplary embodiment, a compression base layer 400 has multiple overlaid performance layers 404 so as to create a compound item of apparel that is customizable for particular attributes desired by a user. In this non-limiting example, the compression base layer 400 is depicted as basically cylindrical, however, in another embodiment, a compression base layer 400 is configured to be worn on portions of the hand other than the fingers or thumb includes a multiple performance layer 404 portion created for a specific portion and installed as a portion of the compound item of apparel. In this non-limiting example, the multiple performance layer 404 component includes layers that provide grip enhancement, shock absorption, impact resistance, microbe resistance, perspiration wicking and diffusion, and other functions as necessary, and in one embodiment is customizable by a user to include any combination of these features in any layer order. The multiple performance layer 404 in one embodiment is a separate construction that is attached to the compression base layer 400, or the multiple performance layer 404 is manufactured as a portion of the process of manufacturing the compression base layer 400 such that it is integrated into the compression base layer 400 forming a single apparel apparatus structure that is composed of the compression base layer 400 and the customized multiple performance layer 404.

Figure 4B:
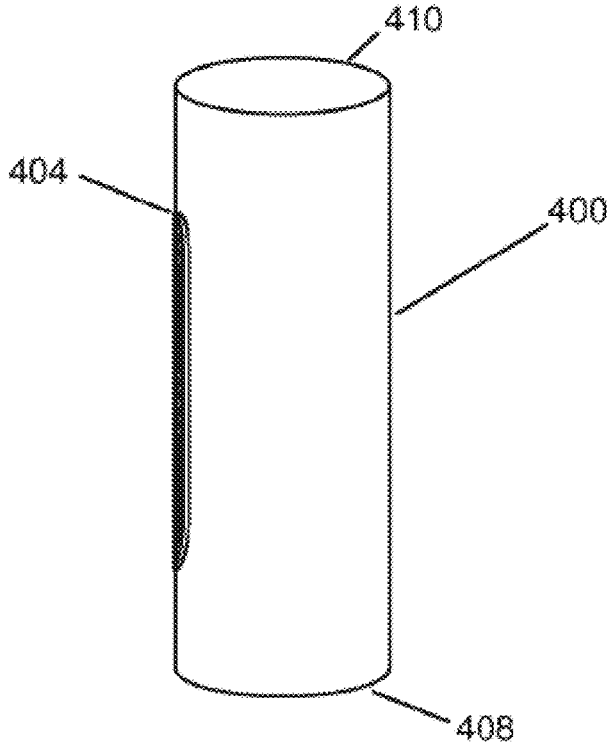
FIG. 4B is a side view of the compression base layer overlain with additional performance layers consistent with certain embodiments of the present invention.

Turning now to FIG. 4B, this figure presents a side view of the compression base layer overlain with additional performance layers consistent with certain embodiments of the present invention. In this exemplary embodiment, the compression base layer 400 includes a cylindrical cross-section for placement on a finger or a thumb. The compression base layer 400 is, in one embodiment, of sufficient length to cover the entirety of a finger or a thumb, or a pre-determined portion of a finger or thumb. In this non-limiting example, a compression base layer 400 has a length that is less than the length of a finger or thumb, and the proximate portion 408 and distal portion 410 of the compression base layer 400 are open to permit a finger or a thumb to be inserted through the compression base layer 400 in a manner such that the tip of the finger or thumb extends above the distal portion 410 of the compression base layer 400. In additional non-limiting examples, the compression base layer 400 has a closed distal portion 410 such that this portion forms a covering over the tip of a finger or thumb. In another embodiment, the compression base layer does not have a cylindrical cross-section, but instead is formed to be placed on the palm, back, or sides of the hand. In each exemplary configuration, the compression included at least one overlain performance layer 404, which in one embodiment is composed of one or more performance layers that assist with grip enhancement, impact resistance, shock absorption, microbial resistance, heat resistance, or any other performance enhancement that may be desired to protect the hands of a user from external contacts while not interfering with a user's grip objects, catch objects, or otherwise interfere with the user's ability to use their hands in pursuit of sports, work, or other activities.

In this exemplary embodiment, the performance layers are combined in such a way as to overlay one or more performance layers in a multiple performance layer 404 where the performance layers form an addition to the compression base layer 400. This multiple performance layer 404 is shown in profile as being in full contact with the outer surface of the compression base layer 400. However, in other embodiments, the multiple performance layer 404 is composed of performance layers that are interwoven, or otherwise integrated, into the structural outer surface of the compression base layer 400. As seen in this profile view, the multiple performance layer 404 is in full contact with the compression base layer 400 so as to cover a portion of the compression base layer 400 that will protect a pre-determined section or impact point on the hands of a user.

Figure 5:
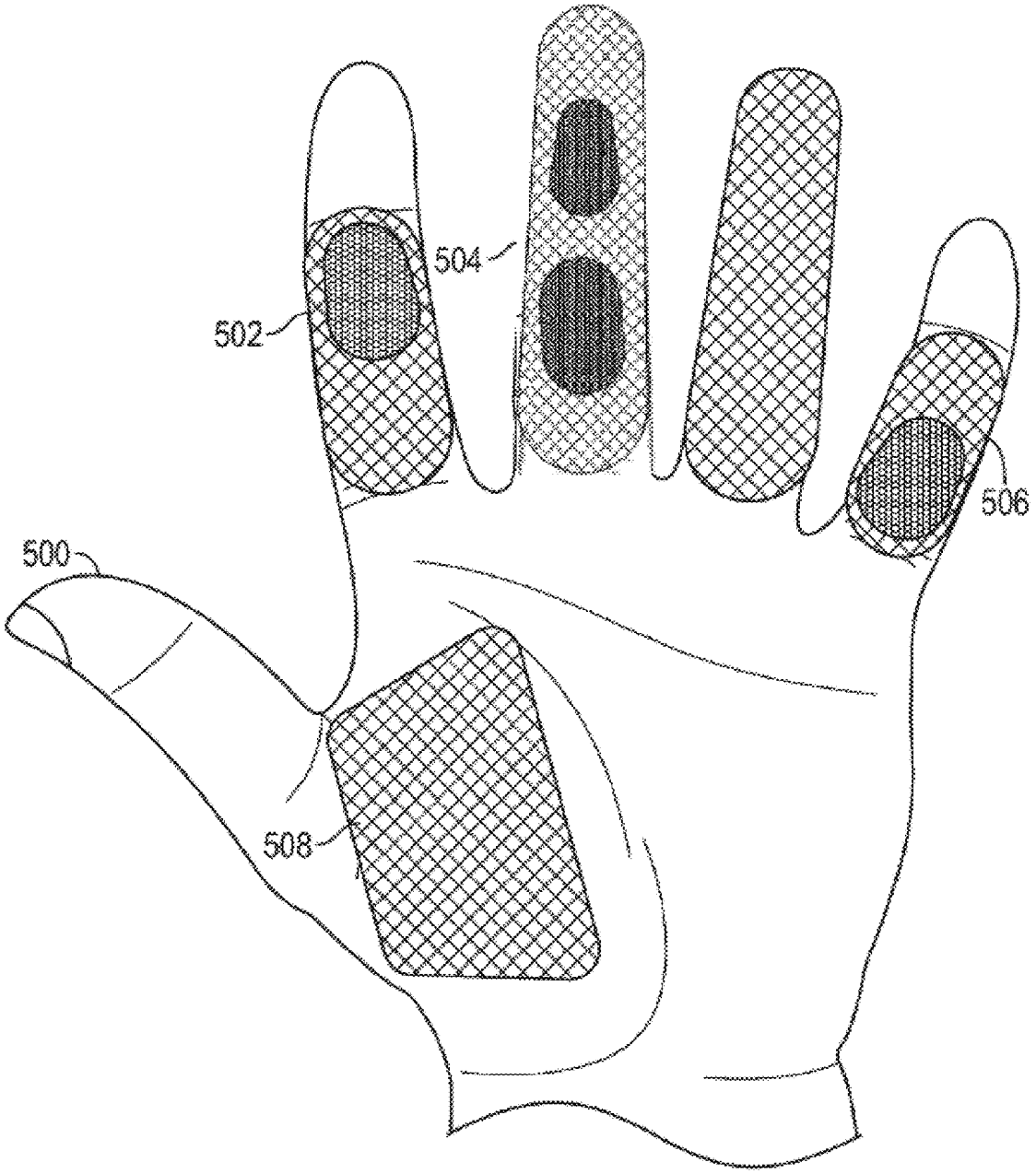
FIG. 5 is a view of the compression base layer with performance layers positioned on portions of the hand consistent with certain embodiments of the present invention.

Turning now to FIG. 5, this figure presents a view of the compression base layer with performance layers positioned on portions of the hand consistent with certain embodiments of the present invention. In this exemplary embodiment, a view of the versatility of the apparel apparatus is presented. A user's hand 500 has multiple portions that the article is operable to improve. The apparel apparatus in one embodiment is, consequently, configured and manufactured for a close fit for various portions of the user's hands. In a non-limiting example, at 502 the apparel apparatus is configured to fit over a finger of the user but not cover the entire length of the finger.

In an alternative example, at 504 the apparel apparatus is configured with a cylindrical cross-section to fit over a finger of a user and a length to cover sufficiently the entire finger, from the base of the finger to the tip of the finger. The apparel apparatus further consists, in one embodiment, of the compression base layer and one or more performance layer portions placed upon the exterior surface of the compression base later and positioned in such manner that one performance layer portion enhances and/or protects one section of a user's finger and other performance layer portions is positioned in such a manner as to protect a completely different section of a user's finger, as shown in 504.

In yet another non-limiting example, at 506 the apparel apparatus is sized sufficiently to fit on the bottom portion of a finger, while leaving the upper portion of the finger, including the tip of the finger, outside of the compression base layer of the apparel apparatus. In the non-limiting example at 506, an additional performance layer is also be positioned on any portion of the apparel apparatus that is most conducive to the user's needs. As has been stated previously, the apparel apparatus is further constructed to, in one embodiment, conform to portions of the user's hands other than the fingers and thumb. This configuration is presented at 508 where a contoured example of the apparel apparatus has been affixed to a portion of the palm of the user's hand to provide protection and/or grip enhancement to that portion of the user's hand.

As is shown in these non-limiting examples, the apparel apparatus is, in one embodiment, constructed in a plurality of contours, configurations, and cross-sectional portions to permit the apparel apparatus to be affixed to fingers, thumb, palm, back, or the sides of a user's hands. The apparel apparatus in a further embodiment is composed of a plurality of performance layers that are attached to or integrally constructed with a compression base layer. The performance layers are constructed in a pre-determined configuration of layers, or they are constructed in conformance to a user's specification for grip enhancement, shock absorption, impact resistance, microbial protection, moisture wicking, or additional functions that may be considered important to include in the apparel apparatus. The apparel apparatus in any configuration will be constructed so as to be worn by a user without impacting the user's ability to grip objects, catch objects, or otherwise interfere with the user's ability to use their hands in pursuit of sports, work, or other activities.

In an embodiment, the apparel apparatus includes communications capability through use of Microchips, Radio Frequency IDs (RFIDs), Electromagnetic Fields generation, Bluetooth, NFC, and/or Accelerometer technology embedded into the apparel apparatus. These technological capabilities are, in one embodiment, embedded as an additional performance layer, or are integrated into the compression base layer. This technological capability permits the apparel apparatus to collect data to track players' performance and transmit the collected data servers and processors to permit digital storage and data analysis of all collected data. By way example and not of limitation, in basketball sensors are placed in the ball, the rim and the apparel apparatus, wherein the sensors are operable to automatically identify and record assists, rebounds shots, velocity of passes, impact of the ball or a fall, speed, location, distance covered, and additional performance characteristics and transmit the identified and recorded information to a computer or computer server. In a further data collection embodiment, the product is further operable to determine frequency, duration, intensity time of release (of an object), height of release, patterns of movement, quality of rest, and calories expended and communicate the data to a computer or computer server. The technologically enhanced apparel apparatus is operable to include one or more of the Microchips, RFIDs, Electromagnetic Field generators, Bluetooth chip, NFC chip, or Accelerometers, wherein a server computer is operable to identify and record sensor data for each sleeve or a multiplicity of sleeves. In a further embodiment, each sleeve or each set of sleeves includes an identification (ID) number, wherein the ID number is transmitted with the sensor data, and wherein the server computer is operable to track, store, and analyze motion for each corresponding ID number. In other non-limiting examples, equipped with additional sensors, the apparel apparatus is operable to track path, acceleration, distance covered and time that distance was covered in, in any activity. This could permit the technologically enhanced apparel apparatus to perform as the primary source of data collection or data distribution in a plurality of sports activities.

Figure 6:
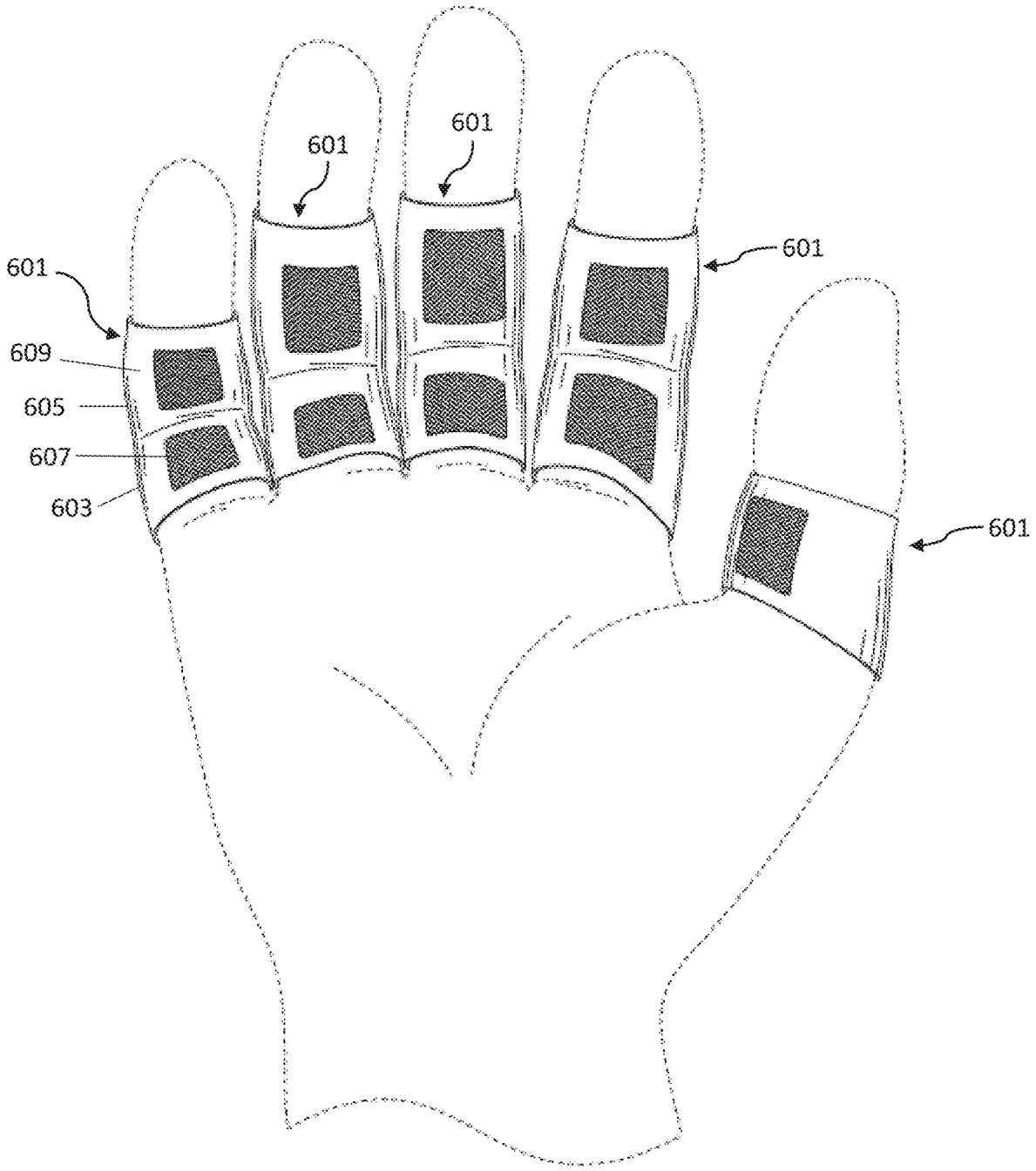
FIG. 6 illustrates a front view of finger sleeves for each digit of a human hand, including a thumb sleeve with a single grip zone, according to one embodiment of the present invention.

FIG. 6 illustrates one embodiment of the grip enhancing sleeve. In this embodiment, there is at least one sleeve 601 for each of one or more fingers. At least one sleeve 601 has a proximal region 603 and a distal region 605, which are designed to provide grip, compression, and protection to targeted zones of a user's finger. The proximal region 603 is constructed to cover a proximal phalanges area, and the distal region 605 is constructed to cover an intermediate phalanges area. In yet another embodiment, the distal region 605 covers the distal phalanges area, and an intermediate region is present between the distal and proximal regions which covers the intermediate phalanges area. In yet another embodiment, the sleeve extends past the proximal region 603, opposite the distal region 605, and is constructed to cover a portion of a user's palm. The sleeve functions to bend with the finger, allowing a user's finger to grasp an object as it would normally. Particularly, segmented grip zones 607 and a seamless textile material 609 allow a user to position the grip zones at ideal locations on a finger such that the sleeve does not result in excess material which may impede bending and create stress points within the article. The sleeve further includes an anterior side and a posterior side, where the anterior side is constructed to be worn adjacent to the user's palm, and the posterior side is constructed to be worn adjacent to the back of the user's hand. Each of the proximal and distal regions include one or more grip zones 607 on the anterior side of the sleeve. In one embodiment the grip zones 607 are substantially rectangular in shape; however, in alternative embodiments, each grip zone 607 is constructed from one or more shapes including a circle, triangle, trapezoid, or any shape or pattern that is operable to assist in gripping an object. Preferably, grip zones 607 are polygonal in shape.

The sleeve 601 advantageously allows a grip feel that is similar to a natural gripping motion, such that the user does not need to supply excess force to hold an object. In contrast to the prior art, where gloves or similar articles may significantly impede a hand's range of motion, and where a secure grip often requires significant force, the sleeved construction, according to one embodiment of the present invention, allows a natural gripping motion that further eliminates stress points, such as those between the base of the fingers in traditional athletic gloves. One element supporting this advantageous aspect is the textile structure of the sleeve 601. This textile structure, by applying compression to the finger, provides additional stability and grip strength. The textile structure is seamless in order to avoid weak points or stress points that often lead to tears or splitting of seams and reduce performance of the sleeve. In one embodiment, the sleeve 601 is made of fibers that are composed of polyester and spandex. In one embodiment, this fiber is LYCRA. In a preferred embodiment, these fibers are interwoven with a thermo-reactive or infrared fiber that returns expended energy to the user. In yet another preferred embodiment, this thermos-reactive fiber is CELLIANT. In a further embodiment, materials used in the sleeve include at least one layer of infrared yarns, ceramic yarns, carbon fiber yarns, silk, graphene, cotton, rayon, polyester, spandex, or any other fiber or textile material known in the art. The woven fibers are, in one embodiment, 0% to 95% biocomponent fiber. In another embodiment, the woven fibers are 50% to 90% biocomponent fiber. In a further embodiment, the woven fibers are approximately 80% biocomponent fiber. The woven structure of the sleeve also allows moisture, such as sweat, to escape from the finger, helping to cool the user and maintaining grip strength. Notably, the sleeve is constructed out of one or more compression layers, performance layers, and or additional layers from any of the materials disclosed herein. In one embodiment, the sleeve is woven. In another embodiment, the sleeve is knit. In a further embodiment, the sleeve is molded from one or more of the disclosed materials.

Figure 7:
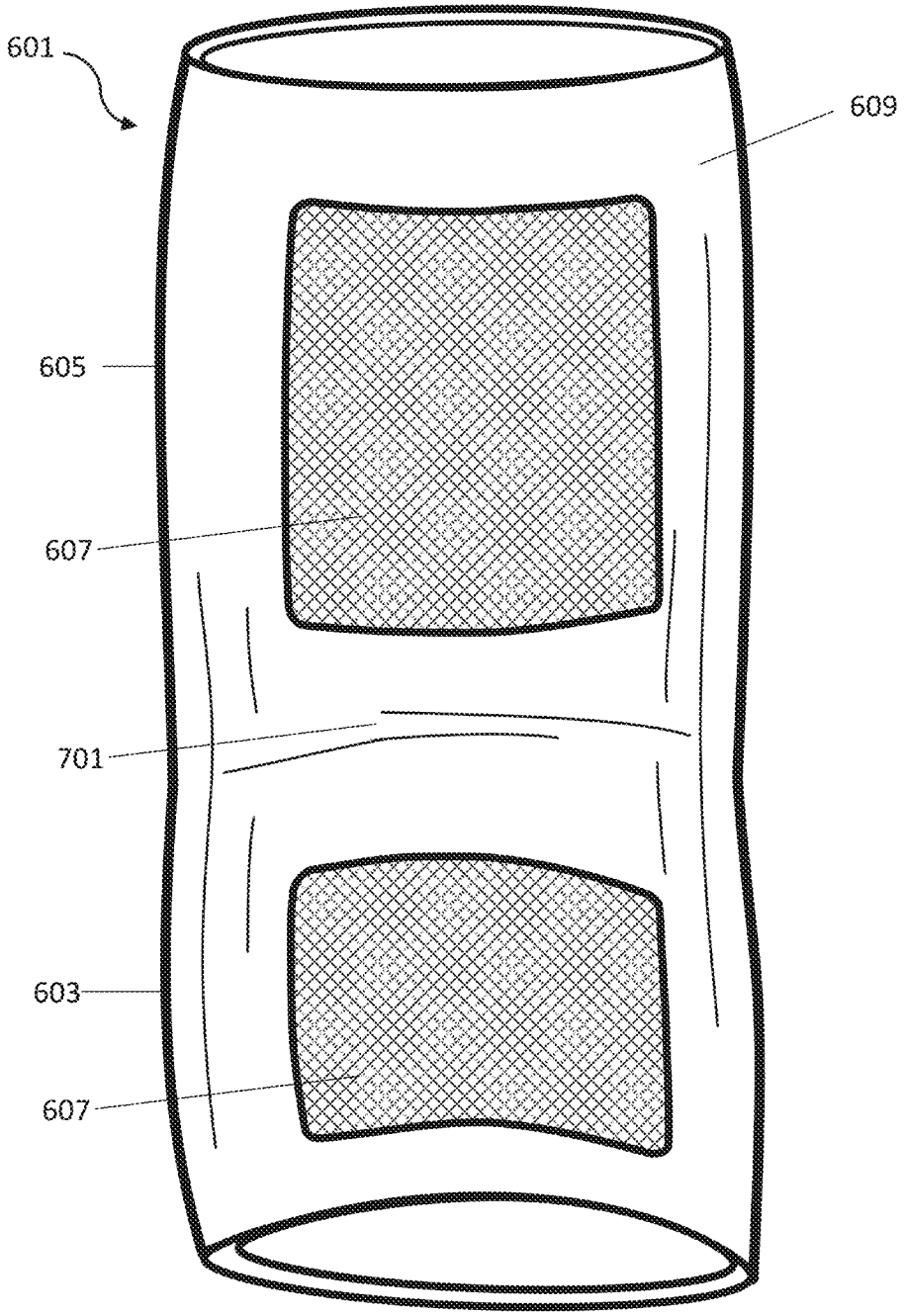
FIG. 7 illustrates a front view of a sleeve with two grip zones according to one embodiment of the present invention.

FIG. 7 further illustrates another embodiment of a single sleeve 601 from FIG. 6 and demonstrates a slight bend 701 in the sleeve, as seen from the anterior side. The grip zone 601 covers a substantial portion of the anterior side of the sleeve but does not cover it completely, wherein a user's finger retains its normal bending abilities during use of the sleeve. In one embodiment, the grip zones 607 cover between 10% and 95% of the surface area of the anterior side of the sleeve. In another embodiment, the grip zones 607 cover between 20% and 95% of the surface area of the anterior side of the sleeve. In a preferred embodiment, the grip zones 607 cover between 50% and 90% of the surface area of the anterior side of the sleeve.

The grip zone 607 enhances control, including grip, of a user on an object. In some embodiments the grip zone 607 accomplishes this through material composition and/or topographical shape. In a preferred embodiment, the grip zone 607 is composed of a silicone blend. In another embodiment, the grip zone 607 and/or the base layers include phosphorescent materials such that the sleeves have "glow-in-the-dark" elements. The grip zone 607 extends outwards from the surface of the sleeve itself. In one embodiment, the grip zone 607 extends past the surface by a distance of 0.01 mm to 4 mm. In another embodiment, the grip zone 607 extends past the surface by a distance of 0.05 to 2 mm. In another embodiment, the grip zone 607 extends past the surface by a distance of 1.25 mm. In another the embodiment, the grip zone 607 includes a magnet to help the user better grasp some metal objects, and in another embodiment, the grip zone 607 utilizes a magnet and friction to better grasp objects. In yet another embodiment, the grip zone 607 is made of hook and loop fabric to help the user better grasp fabrics. Different thicknesses of grip zones provide advantages for a variety of use cases. For example, in athletic applications, an athlete may prefer a thinner profile for golf while preferring a thicker profile for football, as an increased thickness provides both more protection and greater grip strength, and a decreased thickness provides more dexterity. Constructing sleeves with an ideal thickness allows for cost effective production of sleeves that meet a wide variety of needs in athletics, industry, or other applications. In one embodiment, an ideal thickness for use across multiple applications is approximately 1.25 mm when integrated into a sleeve. In another embodiment, the silicone blend has a Shore A durometer of between 0 and 70. In another embodiment, the silicone blend has a Young's modulus of between 0.001 and 0.1 GPa.

Figure 8:
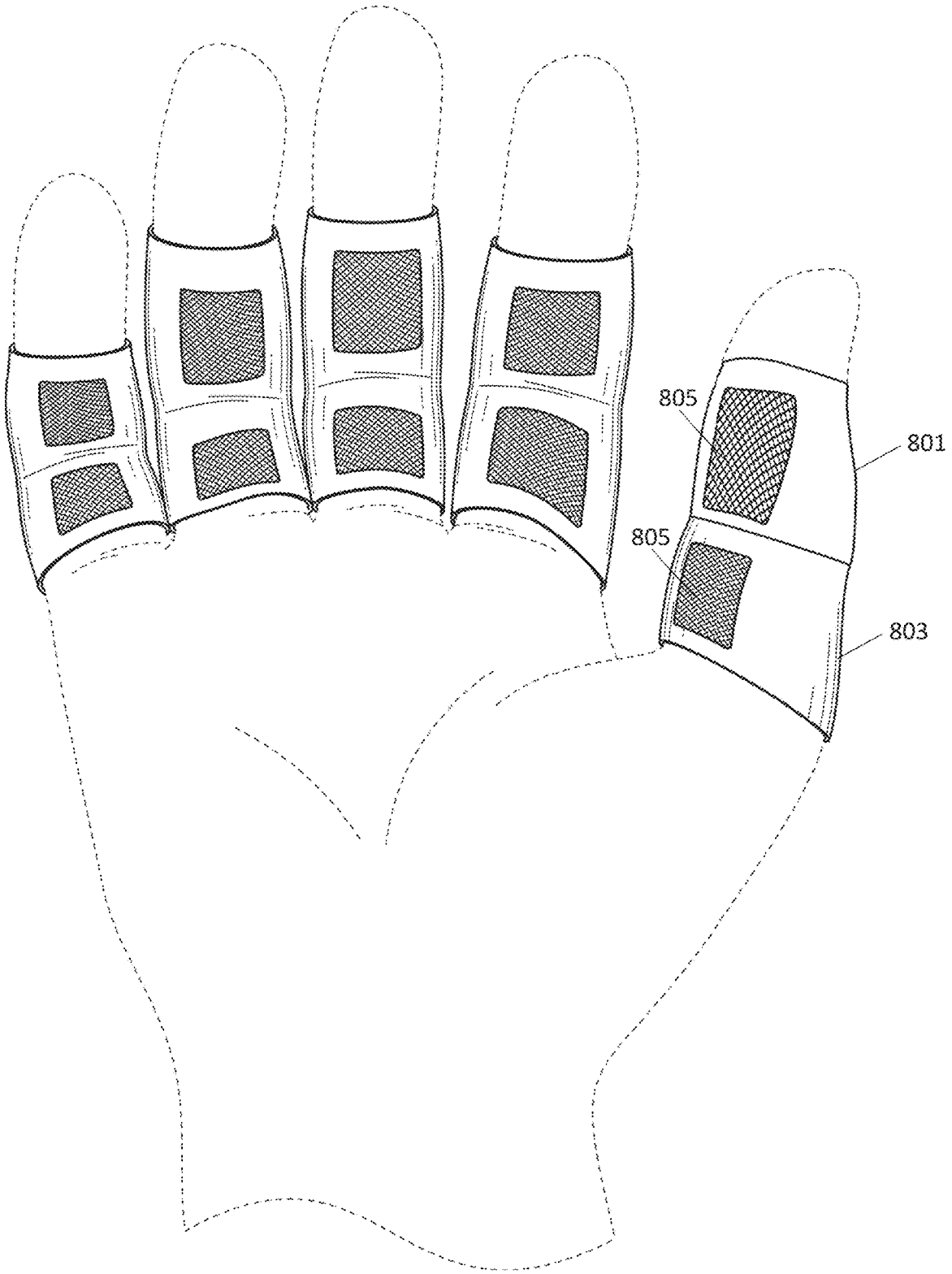
FIG. 8 illustrates a front view of sleeves for each digit of a human hand, including a thumb sleeve with two grip zones, according to one embodiment of the present invention.

FIG. 8 illustrates an alternative embodiment of a hand wearing sleeves on each finger and thumb, wherein a sleeve for a thumb includes two grip sections, including a distal first grip section 801 and a proximal second grip section 803. The first grip section 801 and the second grip section 803 are preferably constructed in a single, seamless sleeve with dual grip zones 805, similar to each of the sleeves with dual grip zones for other fingers. In a further embodiment, the grip zone 805 is constructed with a single, extended area of grip material, wherein the grip zone 805 extends from the distal region 801 of the sleeve to the proximal region 803. Preferably, an extended thumb sleeve is constructed with similar construction and materials to other dual-zone sleeves, including compression knitting, internal gripping material to secure the sleeve during use, and a rear spine for flexibility and strength of material. In one embodiment, the distal end 801 of a thumb sleeve is not open but is instead enclosed, wherein the grip zone extends to a tip of the thumb 807 and/or the whole of the distal region 801 is constructed from a grip material such that the entire distal region 801 is a grip zone.

Figure 9A:
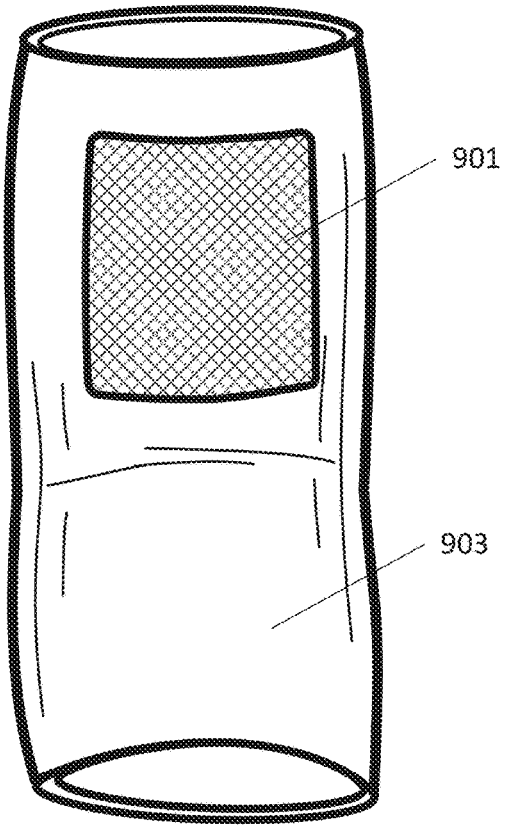
FIG. 9A illustrates a front view of a sleeve with a distal grip zone according to one embodiment of the present invention.
Figure 9B:
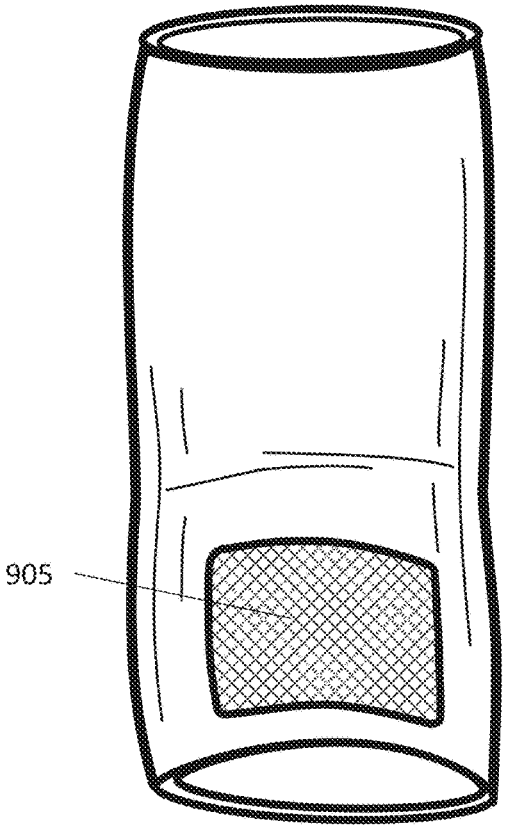
FIG. 9B illustrates a front view of a sleeve with a proximal grip zone according to one embodiment of the present invention.
Figure 9C:
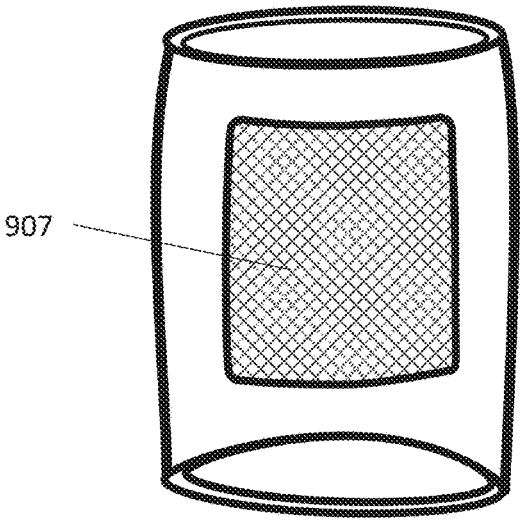
FIG. 9C illustrates a front view of a short sleeve with a single grip zone according to one embodiment of the present invention.

FIG. 9A illustrates an alternative embodiment for a grip zone, wherein the grip zone 901 is constructed such that the grip zone 901 is positioned in a distal region of the sleeve. The proximal region 903 is constructed with similar compression material but does not have a grip zone, allowing for improved breathability and compression while providing targeted control with a distal grip zone 901. FIG. 9B illustrates a similar embodiment, wherein the sleeve is constructed with a single, proximal grip zone 905, and wherein the proximal grip zone 905 provides grip control close to a palm during use while allowing for compression features of the sleeve to provide support along the intermediate or distal regions of the finger. FIG. 9C illustrates a further embodiment, wherein a shortened sleeve allows for fine control of grip zone placement. The sleeve preferably includes in one embodiment a single grip zone 907 and is approximately the size of a single proximal, intermediate, or distal finger region, corresponding to a finger for which the sleeve is constructed. In one embodiment, the shortened sleeve is between 5 mm and 45 mm long and has a diameter of between 8 and 30 mm when not stretched. In another embodiment of a shortened sleeve, wherein the sleeve covers the fingertip, the shortened sleeve is between 25 mm and 70 mm long and has a diameter of between 8 and 30 mm when not stretched. In another embodiment, a full size sleeve is between 25 mm and 75 mm long and has a diameter of between 8 and 30 mm when not stretched. In another embodiment of the full size sleeve, wherein the sleeve covers the fingertip, the full size sleeve is between 45 mm and 90 mm long and has a diameter of between 8 and 30 mm when not stretched. Advantageously, the shortened sleeve provides grip zone positioning at an ideal location along a finger while reducing unwanted bulk. For example, in one embodiment, shortened sleeves are worn in the intermediary or distal regions of a set of fingers for rock climbing. In another embodiment, the shortened sleeves are worn in the intermediary or proximal regions of a set of fingers for mountain biking.

In one embodiment, a set of sleeves includes at least five sleeves, wherein at least two of the sleeves differ in length and diameter to fit each finger and thumb with a similar amount of compression. For example, in one embodiment, a thumb sleeve is shorter than the finger sleeves. In another embodiment, each of the sleeves differ in length and diameter. Preferably, compression is approximately consistent across sleeves, wherein the sleeves are constructed with a compression level that prevents movement of the article during use and encourages healthy blood flow, but wherein blood flow is not entirely constricted. In an alternative embodiment, the sleeve is adjustable via a pull string, interlocking material (e.g., VELCRO), adhesive, snap, clasp, or other mechanism that allows for adjustable tightening before or during use of the article.

Grip zones are advantageously integrated within the textile material of the sleeve without the material bleeding through the base layer. For example, a silicone grip zone is integrated within a textile base layer such that the silicone provides a grip zone, but wherein the internal surface of the article does not have silicone that protrudes, and wherein a user would not feel the silicone material. In one embodiment, the grip zones are constructed from "tacky" materials that provide a higher coefficient of friction than hands when in contact with another material. In one embodiment, this is measured in a static or kinetic coefficient of friction, wherein the static and/or kinetic coefficient of friction of the grip zone in contact with rubber, metal, rock, concrete, plastic, or other polymer is higher than the textile and/or a hand with any of these materials when each are dry and/or wet. Preferably, the high frictional force capability of the grip zone is higher than that of the hand, wherein the grip zone requires significantly less normal, grip force to maintain similar levels of frictional forces. In one embodiment, grip zones provide between 5 and 30 times more frictional force than that of a hand with average grip capacity. In another embodiment, grip zones provide approximately 20 times more frictional force than that of a hand with average grip capacity.

Figure 10:
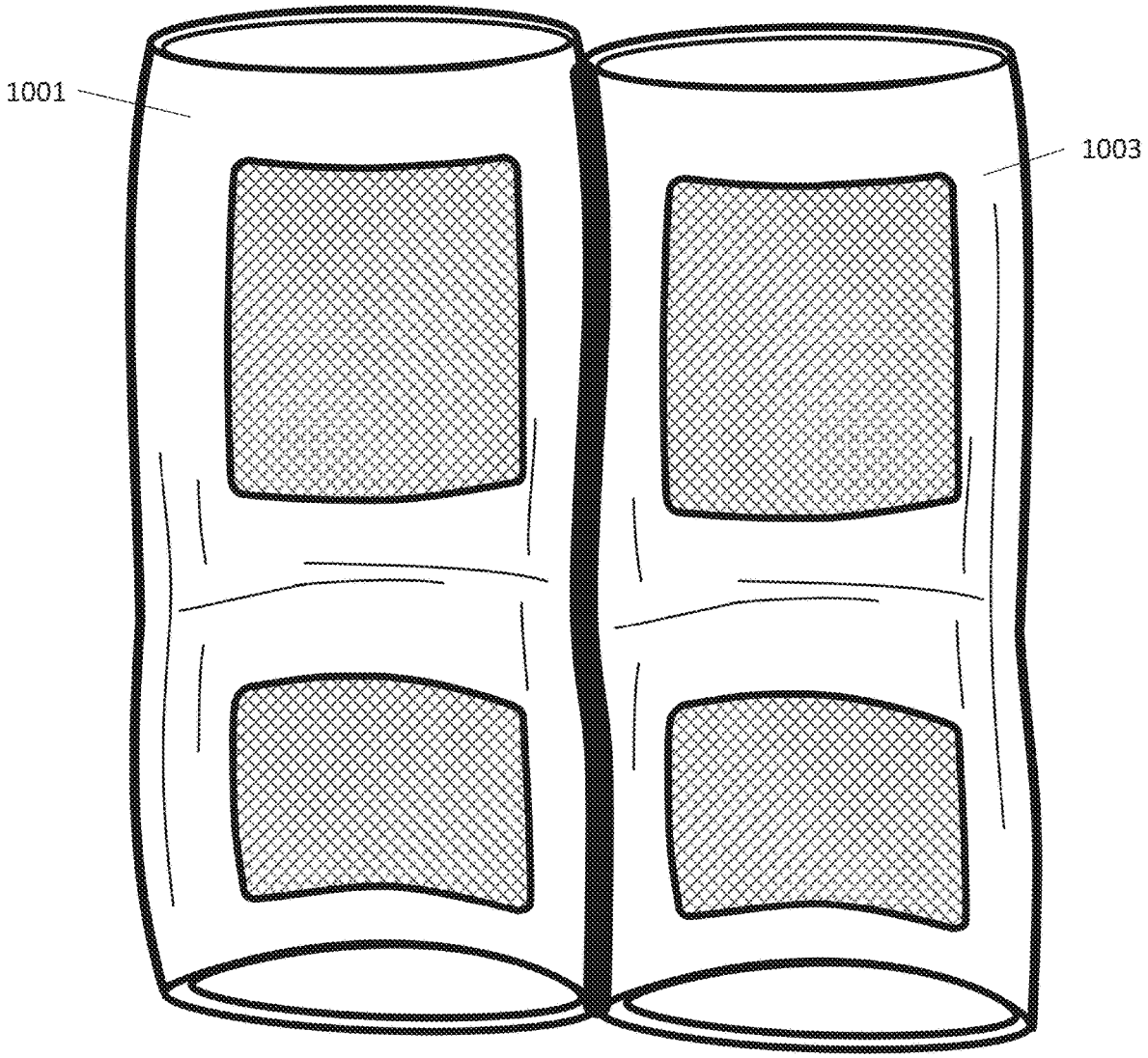
FIG. 10 illustrates a front view of a multi-finger sleeve according to one embodiment of the present invention.

FIG. 10 illustrates one embodiment of a multi-finger sleeve. In the illustrated embodiment, a first sleeve 1001 is attached to a second sleeve 1003. The sleeves are preferably woven together. In an alternative embodiment, the sleeves are attached by way of an adhesive or by physical means. For example, a first sleeve 1001 is attached to a second sleeve 1003 via snaps, magnets, buttons, zippers, or any other method known in the art of mechanical attachment. The multi-finger sleeve illustrated includes two sleeves; however, in another embodiment, a multi-finger sleeve is constructed from three, four, five, or more combined sleeves. The multi-finger sleeve advantageously provides both the support and grip advantages of a single sleeve while also providing support to multiple fingers to aid in injury healing, to provide support for endangered extremities, and/or to encourage proper finger positioning for specific sporting techniques. The multi-finger embodiment provides the benefits of improved grip and compression while having similar functionality to methods of "buddy taping," or securing fingers together with tape or similar elements to promote healing. Alternatively, the multi-finger sleeve or a single sleeve includes a channel for inserting a support piece, such as a rod, to serve as a splint for the finger or fingers contained. A multi-finger sleeve, in one embodiment, provides a flat face, wherein the sleeves are partitioned and attached, but wherein an outside of the multi-finger sleeve provides a single, flat surface and appears unified in construction. Grip zones in multi-finger embodiments are alternatively constructed across sleeves, wherein grip zones extend horizontally across a sleeve and/or follow corresponding phalangeal regions (e.g., distal, intermediate, proximal) for each finger that the sleeve covers. In some embodiments, a front face of a multi-finger sleeve is between 60% and 95% covered by one or more grip zones.

Figure 11A:
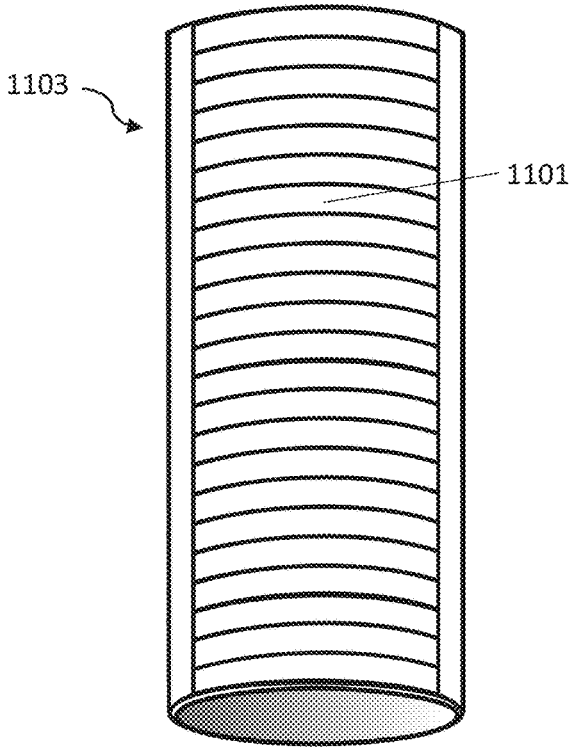
FIG. 11A illustrates a rear view of a sleeve with a full-length spine according to one embodiment of the present invention.
Figure 11B:
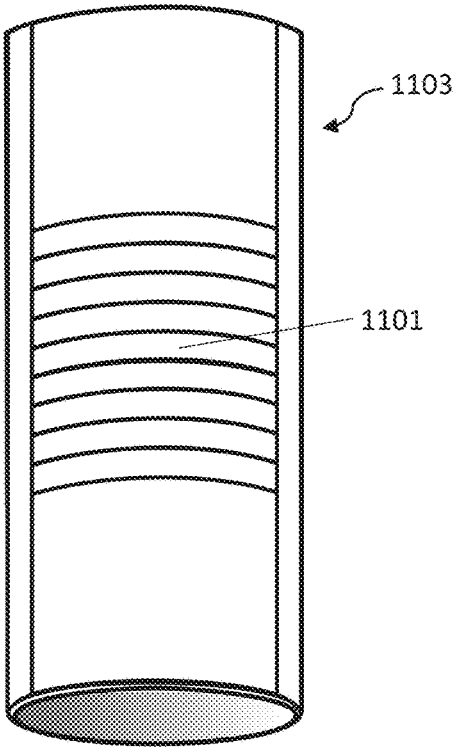
FIG. 11B illustrates a rear view of a sleeve with a joint spine according to one embodiment of the present invention.
Figure 11C:
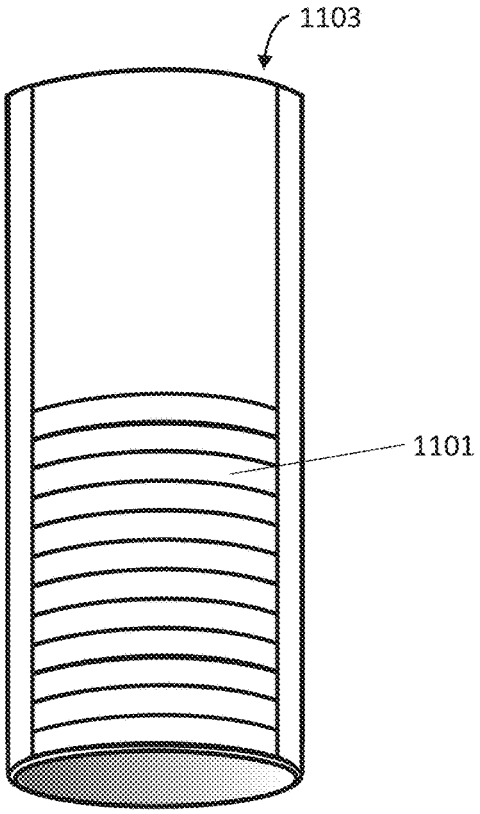
FIG. 11C illustrates a rear view of a sleeve with a proximal spine according to one embodiment of the present invention.
Figure 11D:
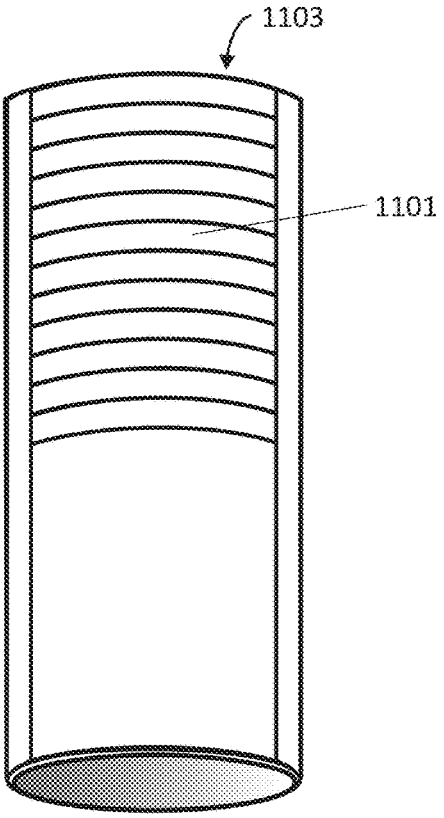
FIG. 11D illustrates a rear view of a sleeve with a distal spine according to one embodiment of the present invention.

FIG. 11A illustrates a spine 1101 of a sleeve 1103, wherein the spine is constructed with segmented padding materials. The spine 1101 provides both protection and comfort via increased padding material while also increasing article strength through reinforcing fibers. In one embodiment, the spine is constructed from folded or pleated textile material, wherein the textile material is identical or equivalent to textile material employed in the base material of the sleeve. In another embodiment, the spine is filled with padding material, including cotton, polyester, rubber, silicone, gel, or any other suitable material that provides protection in athletic activities. The segmented construction of the spine advantageously provides structure and supplementary fibers such that the article is operable to extend and bend without causing excess strain on the fibers of the sleeve. The additional material of the spine provides both padding to a user as well as reinforces, unfolds, and/or extends to provide range of motion without over stretching the article. Preferably, the spine extends along a full length of the sleeve. However, in an alternative embodiment illustrated in FIG. 11B, the spine 1101 extends between two intermediate locations on the sleeve 1103. For example, in the illustrated embodiment, the spine extends from the proximal region of the sleeve to the distal region of the sleeve. The spine is advantageously positioned to cover the area of a joint of an inserted finger (i.e., the proximal interphalangeal joint or the distal interphalangeal joint) when in use. FIGS. 11C and 11D illustrate complimentary embodiments, wherein the spine 1101 covers a distal and proximal region of the sleeve 1103.

In one embodiment, a full-length spine covers between 10% and 60% of the surface area of a sleeve and is positioned on an external surface opposite the grip zones. In another embodiment, the full-length spine covers between 20% and 30% of the surface area of the sleeve. In a further embodiment, the full-length spine covers approximately 15% of the surface area of the sleeve. In yet another embodiment, the sleeve does not include a spine (as illustrated in FIGS. 14D and 14E). In one embodiment, the spine extends along a full length of the sleeve except for a woven end or anti-fray construction (e.g., a kitted, woven, or stitched end, a laminated end, or a continuous portion of the textile base layer).

The spine is preferably integrated within the sleeve such that it is woven or knit into the textile base layers. In another embodiment, the spine is woven on top of the sleeve and/or is attached by adhesive or other physical, mechanical, or chemical means. In a further embodiment, the spine is removable, wherein a zipper, snap, clasp, adhesive, or frictional material secures the spine in place during use but allows for removal.

Figure 12A:
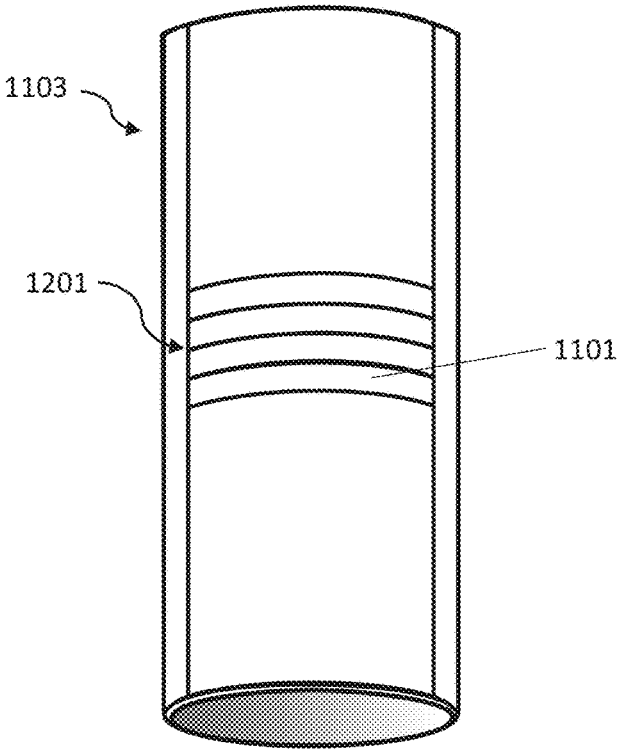
FIG. 12A illustrates a rear view of a sleeve with a shortened joint spine according to one embodiment of the present invention.
Figure 12B:
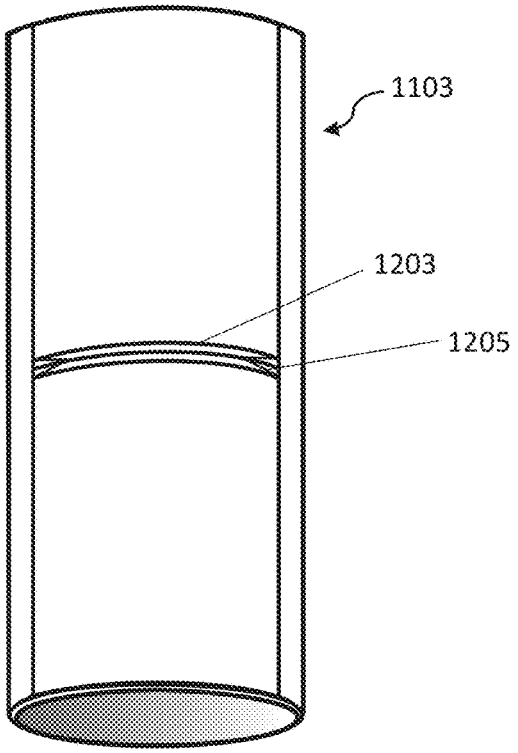
FIG. 12B illustrates a rear view of a sleeve with a rigid joint spine according to one embodiment of the present invention.
Figure 12C:
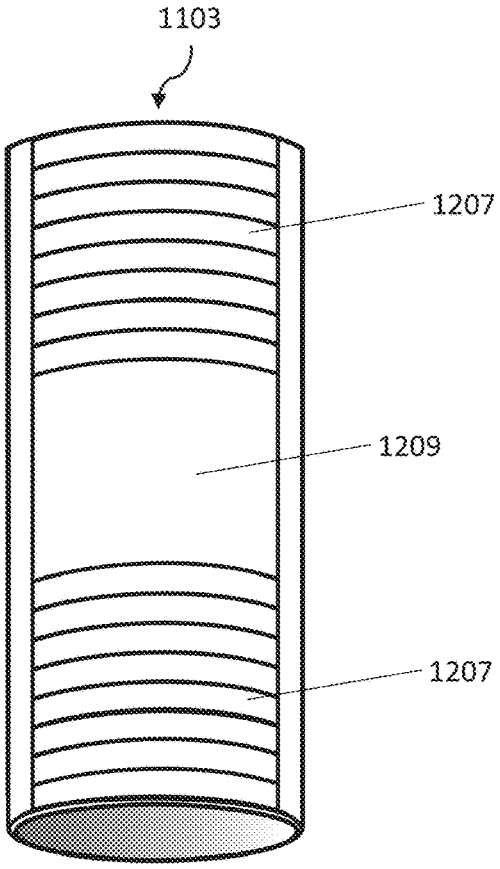
FIG. 12C illustrates a rear view of a sleeve with an inverted spine according to one embodiment of the present invention.

FIGS. 12A and 12B illustrate alternative positions for a spine 1101, wherein the spine 1101 covers varying amounts of the joint region 1201 of the sleeve. FIG. 12A illustrates a spine 1101 that provides more flexibility and padding than the embodiment illustrated in FIG. 11B to provide greater rigidity of the sleeve. FIG. 12B illustrates a small spine 1203 with spine edge reinforcement 1205. FIG. 12C illustrates an inverse spine, wherein the spine 1207 extends across the proximal and distal regions of the sleeve while not covering the joint area 1209. In one embodiment, the joint area 1209 of the inverse spine is reinforced with greater padding, reinforcement textiles, or other additional material that provide more structure and a less flexible construction than the spine of other embodiments.

Figure 13A:
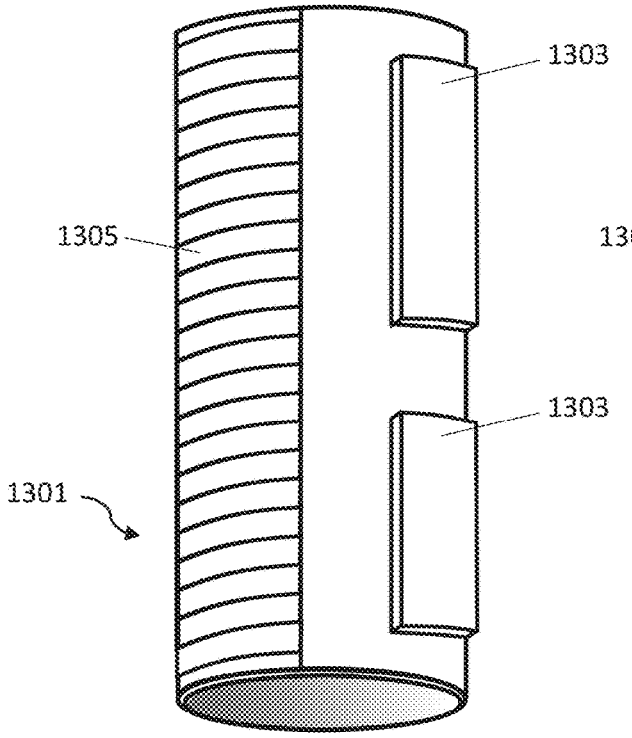
FIG. 13A illustrates a side view of a sleeve with two grip zones and a spine according to one embodiment of the present invention.
Figure 13B:
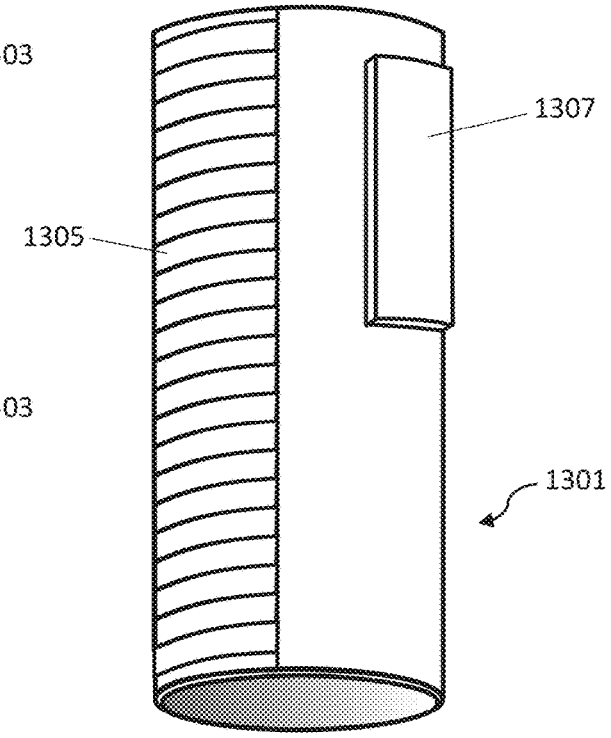
FIG. 13B illustrates a side view of a sleeve with a distal grip zone and a spine according to one embodiment of the present invention.
Figure 13C:
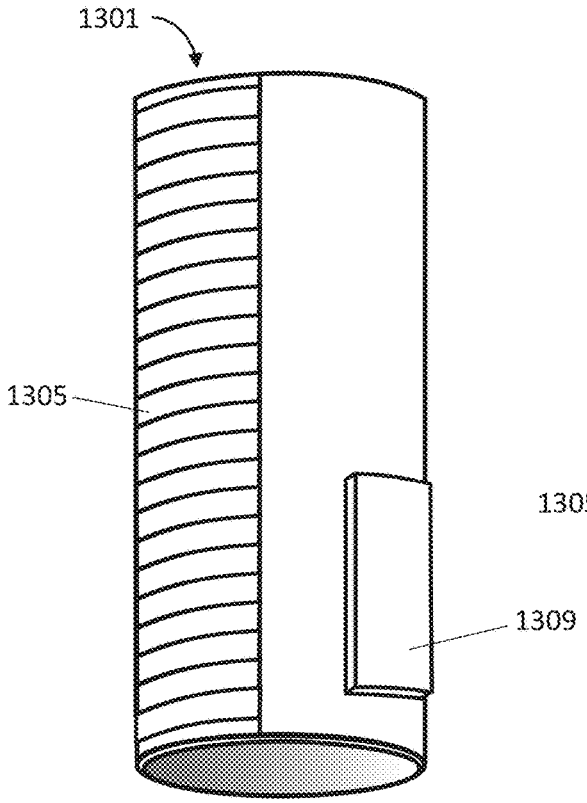
FIG. 13C illustrates a side view of a sleeve with a proximal grip zone and a spine according to one embodiment of the present invention.
Figure 13D:
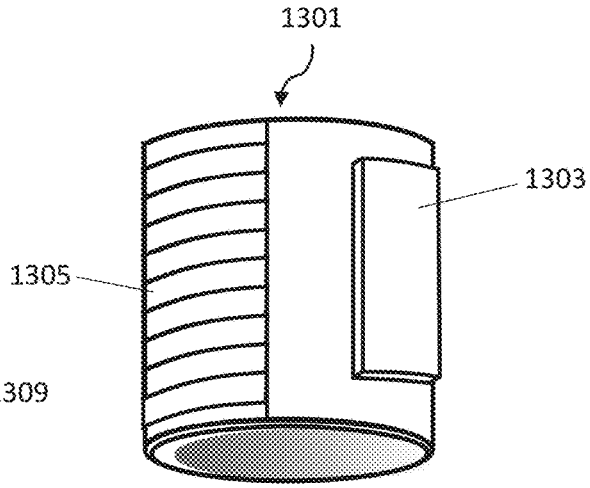
FIG. 13D illustrates a side view of a short sleeve according to one embodiment of the present invention.

FIG. 13A illustrates a side view of a sleeve 1301 with two grip zones 1303 and a spine 1305. FIG. 13B illustrates a side view of a sleeve 1301 with a single, distal grip zone 1307 and a spine 1305. FIG. 13C illustrates a side view of a sleeve 1301 with a single, proximal grip zone 1309 and a spine 1305. FIG. 13D illustrates a side view of a short sleeve 1301 with a single grip zone 1303 and a spine 1305.

Figure 14A:
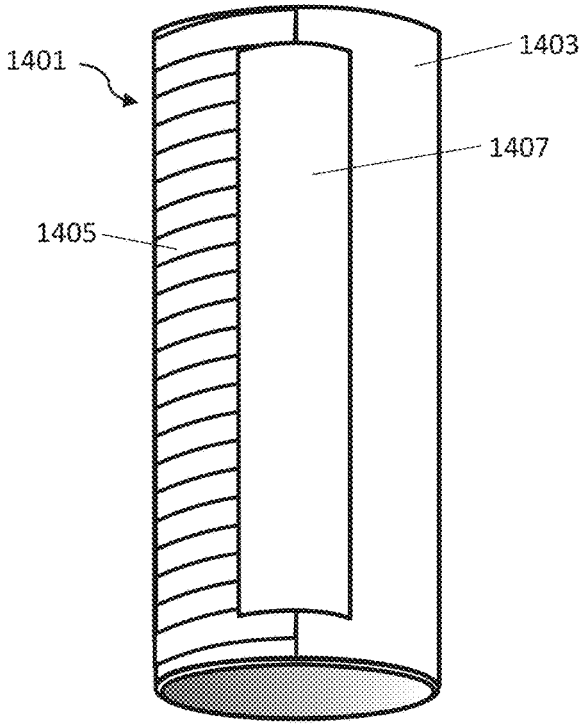
FIG. 14A illustrates a side view of an internal surface of a sleeve with an internal grip zone according to one embodiment of the present invention.

FIG. 14A illustrates a side view of the internal surface of the sleeve 1401. This figure illustrates a side of the sleeve which contacts a side of a finger when used. In this view, the posterior side presents a ribbed spine 1405, anterior side 1403, and anti-slip zone 1407. The anti-slip zone 1407 is placed along the length of the sleeve, extending from the proximal end to the distal end. Each sleeve includes, in one embodiment, at least one anti-slip zone 1407 on each sleeve, and in a preferred embodiment, a sleeve includes two. The anti-slip zones are placed centered on the medial plane of the sleeve, where the anterior side and posterior side connect. The anti-slip zone contacts the skin of the user and functions to prevent the sleeve from twisting on the finger or sliding up and off of the finger during use. In one embodiment, the anti-slip zone covers the entire length of the sleeve. In another embodiment, the anti-slip zone covers between 10% and 95% of the length of the sleeve. In a preferred embodiment, the anti-slip zone covers between 80% and 90% of the length of the sleeve. Furthermore, the anti-slip zone is constructed with any varying width in order to satisfy a variety of intended purposes across a variety of different sized fingers. In one embodiment, the anti-slip zone is between 1 and 10 mm wide. In another embodiment, the anti-slip zone is between 2 and 8 mm wide. In a preferred embodiment, the anti-slip zone is 3 to 6 mm wide. The anti-slip zone is composed of a material that will provide friction against the finger without causing discomfort. In one embodiment, the material is a silicone blend. Preferably, the two anti-slip zones are both collinear in the medial plane of the sleeve. This alignment functions to not inhibit bending of the finger and prevent rotation of the sleeve. When the ant-slip zones are not collinear, or one or both are placed slightly anterior or slightly posterior to the medial plane of the sleeve, the sleeve is liable to rotate around the finger when the user attempts to grasp an object, and will further reduce the user's grip strength and potentially irritate the skin of the user.

In one embodiment, a sleeve includes medial delivery mechanisms, wherein the medical delivery mechanism is either integrated within an internal anti-slip zone or is included additionally to the anti-slip zone. The medical delivery mechanism includes a drug delivery pad, wherein the pad is saturated with traditional topical preparations for the skin, such as lotion or aloe, and/or is saturated with pain relief medication, and/or any other medical delivery for topical application. Alternatively, the medical delivery mechanism includes pores and an internal supply capsule, wherein the pores, for example, are integrated within an anti-slip zone, wherein medication is supplied through the pores to a user's skin.

Figure 14B:
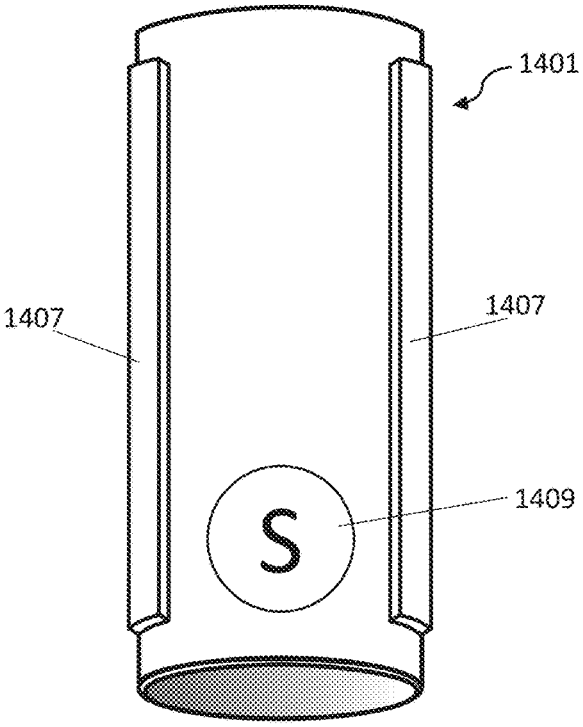
FIG. 14B illustrates a front view of an internal surface of a sleeve with internal grip zones and a size marker according to one embodiment of the present invention.

FIG. 14B illustrates a front view of the internal surface of the sleeve 1401. In this view, the anterior side presents a view of a portion of each of two anti-slip zones 1407 and a graphic indicator 1409. In one embodiment, the anti-slip zones 1407 are of the same size, are collinear, and are at the same height on the sleeve. The graphic indicator 1409 presents a visual indication to a user the size of the sleeve. In another embodiment, the indicator demonstrates to the user which finger the particular sleeve is designated to be worn on. The indicator is printed on to the sleeve. In another embodiment, the indicator is woven into the sleeve using a color of fiber that is different than the sleeve itself.

Figure 14C:
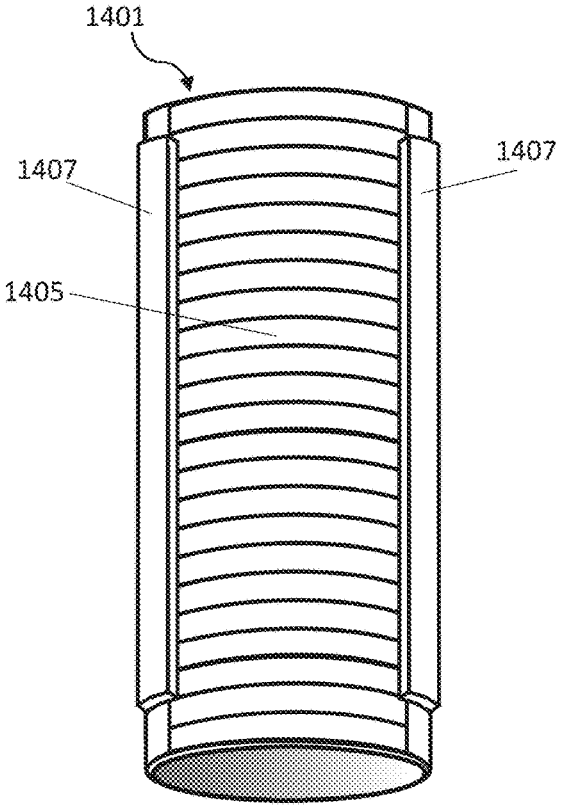
FIG. 14C illustrates a rear view of an internal surface of a sleeve with a spine according to one embodiment of the present invention.
Figure 14D:
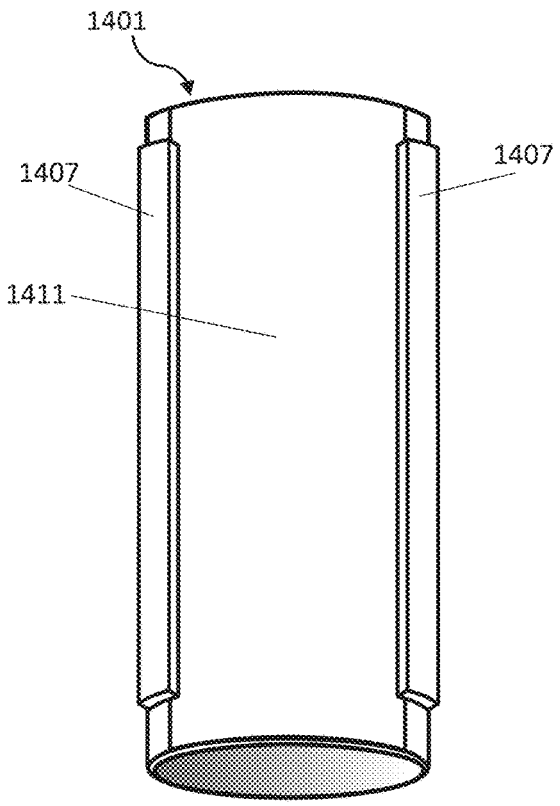
FIG. 14D illustrates a rear view of an internal surface of a sleeve without a spine according to one embodiment of the present invention.
Figure 14E:
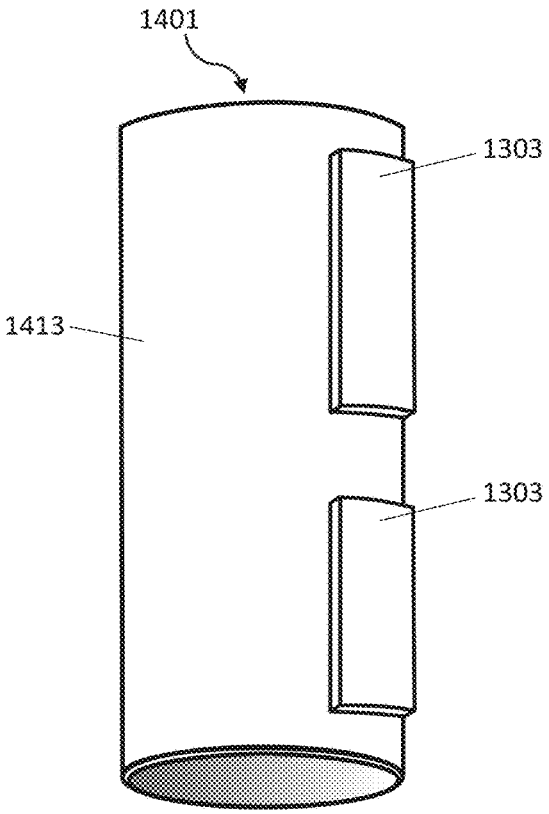
FIG. 14E illustrates a side view of an external surface of a sleeve without a spine according to one embodiment of the present invention.

FIG. 14C illustrates a rear view of the internal surface of the sleeve. In this view, the posterior side presents a view of a portion of each of two anti-slip zones 1407 and the ribbed spine 1405. FIGS. 14D and 14E illustrate one embodiment of the sleeve 1401 without a spine, wherein FIG. 14D illustrates a posterior view of an internal surface of the sleeve 1401 and FIG. 14E illustrates an external side view of the sleeve 1401. In one embodiment, an internal rear surface 1411 and an external rear surface 1413 are constructed fully from the base textile material and/or any other layer that does not include a spine, wherein the sleeve remains seamless. In another embodiment, the internal rear surface 1411 and the external rear surface 1413 include a differing thread size, embedded textured material, and/or visual indicators for positioning (e.g., a change in textile color or printed symbols or colors).

Figure 15:
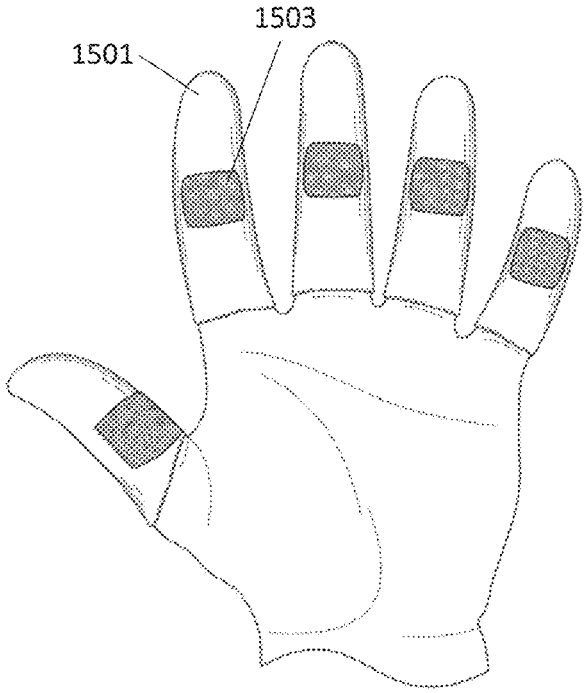
FIG. 15 illustrates one embodiment of full-finger sleeves according to one embodiment of the present invention.

FIG. 15 demonstrates an alternative embodiment where the sleeve 1501 extends past the distal phalanges and covers the end of each finger. In this embodiment, each sleeve has one grip zone 1503, and in another embodiment each sleeve has more than one grip zone. A user may wish their fingertips to be covered if they find themselves in an environment with adverse conditions, such as playing a sport in cold weather.

Figure 16:
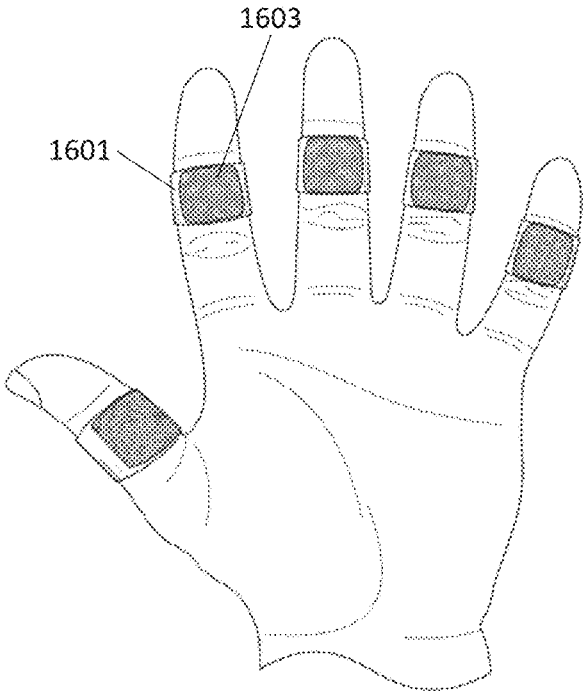
FIG. 16 illustrates one embodiment of sleeves for targeted finger regions according to one embodiment of the present invention.

FIG. 16 demonstrates an alternative embodiment wherein the sleeve 1601 is shorter and covers only the intermediate phalanges of the user. In this embodiment, the sleeve does not need to bend, but it does not restrict bending of the finger of the user. As such, the grip zone 1603 is larger. For example, the grip zone covers between 70% and 100% of the anterior side of the sleeve. In another embodiment, the grip zone covers between 85% and 95% of the anterior side of the sleeve.

Figure 17A:
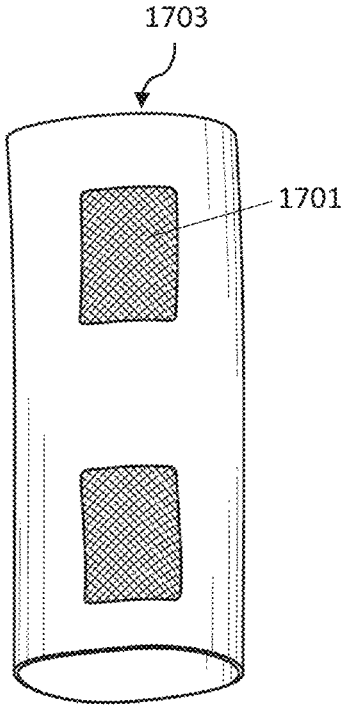
FIG. 17A illustrates a front view of a large sleeve with two grip zones according to one embodiment of the present invention.
Figure 17B:
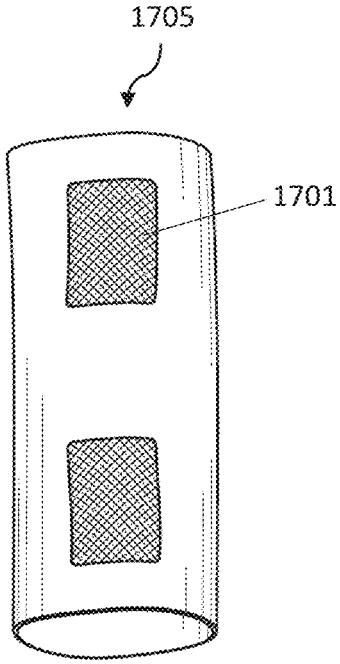
FIG. 17B illustrates a front view of a small sleeve with two grip zones according to one embodiment of the present invention.
Figure 17C:
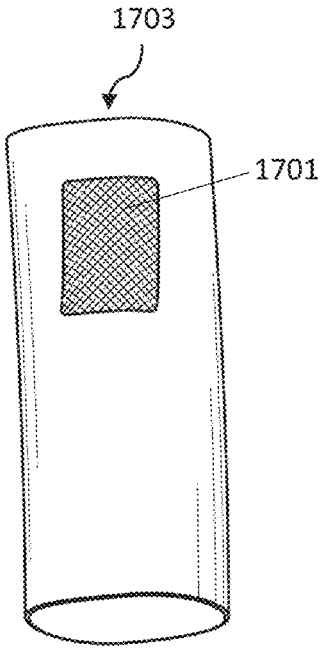
FIG. 17C illustrates a front view of a sleeve with a distal grip zone according to one embodiment of the present invention.
Figure 17D:
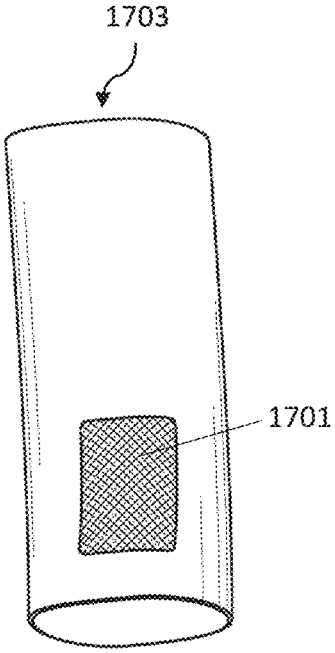
FIG. 17D illustrates a front view of a sleeve with a proximal grip zone according to one embodiment of the present invention.
Figure 17E:
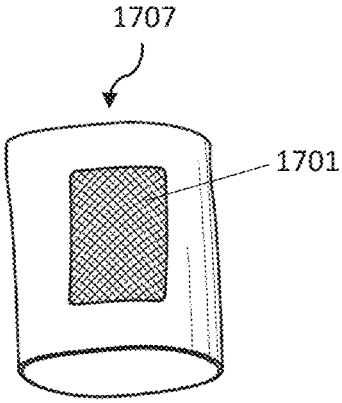
FIG. 17E illustrates a front view of a short sleeve according to one embodiment of the present invention.

FIGS. 17A-E demonstrate alternative embodiments to the sleeve, representing different lengths and placement of the grip zone 1701. For varying applications, a user may wish to have enhanced grip in certain locations but minimal material in others. In the embodiment of FIG. 17A, a standard length sleeve 1703 is present, to cover the proximal and intermediate phalanges, with two grip zones 1701. FIG. 17B represents a shorter length sleeve 1705 that also covers the proximal and intermediate phalanges with two grip zones 1701, but does not cover as much of the phalanges, or is used on a shorter finger. FIG. 17C represents a standard length sleeve 1703 that only has a grip zone 1701 on the distal end, over the intermediate phalanges. FIG. 17D represents a standard length sleeve 1703 that only has a grip zone 1701 on the proximal end, over the proximal phalanges. Finally, FIG. 17E represents a shortened sleeve 1707 designed to only cover one phalanges, and has one grip zone 1701 that covers a larger percentage of surface area of the sleeve.

Figure 18A:
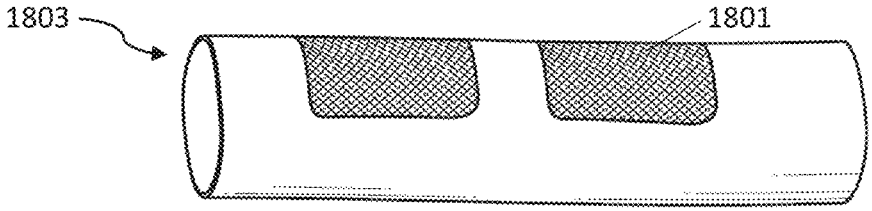
FIG. 18A illustrates a side view of a sleeve with two grip zones according to one embodiment of the present invention.
Figure 18B:
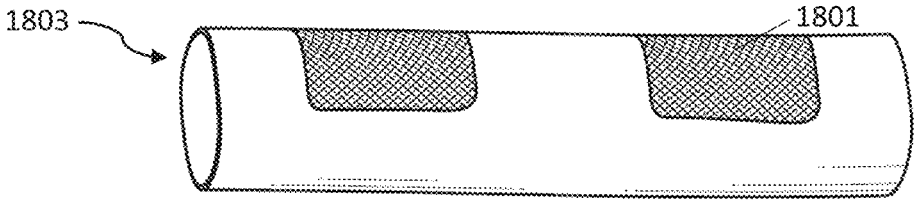
FIG. 18B illustrates a side view of a sleeve with two grip zones according to one embodiment of the present invention.
Figure 18C:
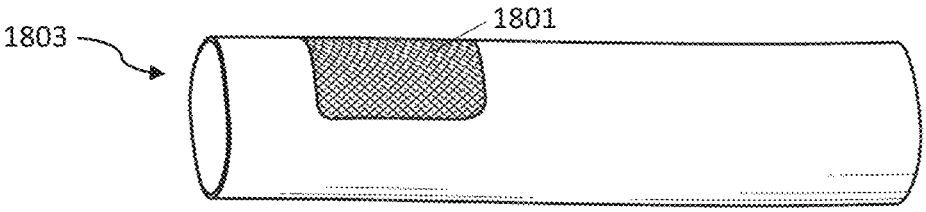
FIG. 18C illustrates a side view of a sleeve with a distal grip zone according to one embodiment of the present invention.
Figure 18D:
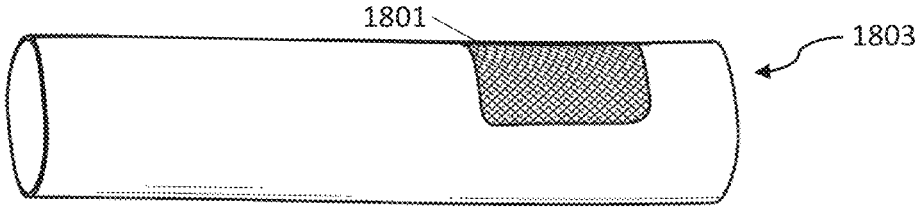
FIG. 18D illustrates a side view of a sleeve with a proximal grip zone according to one embodiment of the present invention.
Figure 18E:
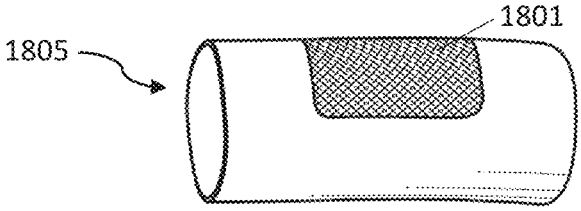
FIG. 18E illustrates a side view of a short sleeve according to one embodiment of the present invention.

FIGS. 18A-D demonstrate alternative embodiments to the sleeve, representing different lengths and placement of the grip zone 1801. The grip zone is operable to be positioned at varying positions along the sleeve, wherein the varying positions benefit different intended uses of the sleeve. FIG. 18A illustrates a standard length sleeve 1803 with two grip zones 1801 which are placed close together. FIG. 18B illustrates a standard length sleeve 1803 with two grip zones that are spread farther apart 1801. FIG. 18C illustrates a standard length sleeve 1803 that has one grip zone 1801 placed on the proximal end of the sleeve. FIG. 18D illustrates a short sleeve 1805 that has one grip zone 1801 that covers a larger percentage of surface area of the sleeve.

Figure 19:
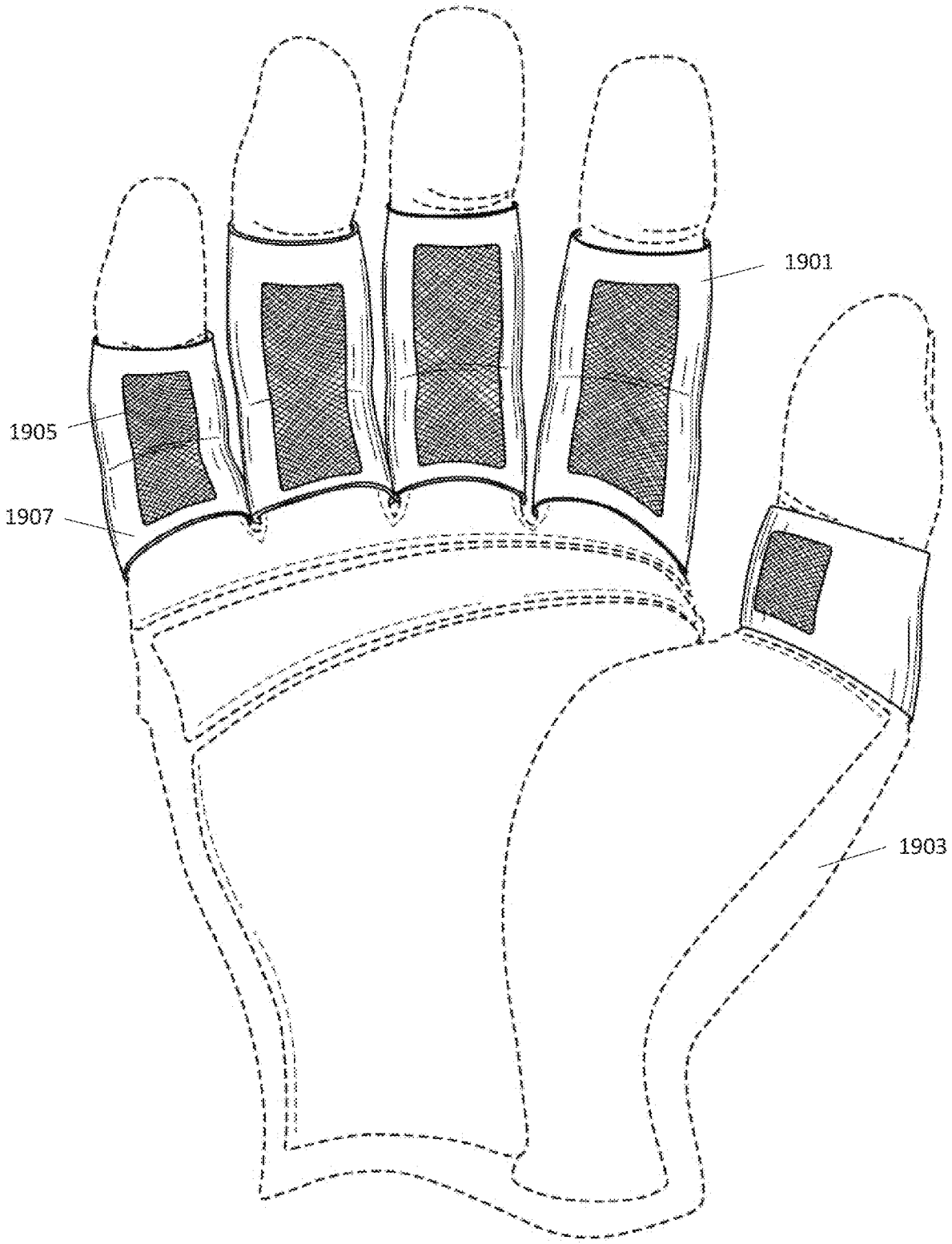
FIG. 19 illustrates a front view of sleeves with an extended grip zones, wherein the sleeves are combined with a glove according to one embodiment of the present invention.

FIG. 19 illustrates an embodiment of the current invention where the disclosed sleeves 1901 are worn over a snug fitting glove 1903. A user may wish to do this in order to protect the rest of the hand, or in adverse weather conditions such as extreme cold. In this case, the glove limits bending of the fingers. As such, the sleeve 190 is adapted to have one, much larger grip zone 1905 in order to maximize grip enhancement in the given situation. This larger grip zone 1905 covers between 60% and 100% of the anterior side of the sleeve 1907. In another embodiment, the grip zone 1905 covers between 75% and 95% of the anterior side of the sleeve 1907. In another embodiment, the sleeves are integrated with the glove so as to not further increase the overall thickness of the gloves other than the increase due to the grip zone.

Figure 20:
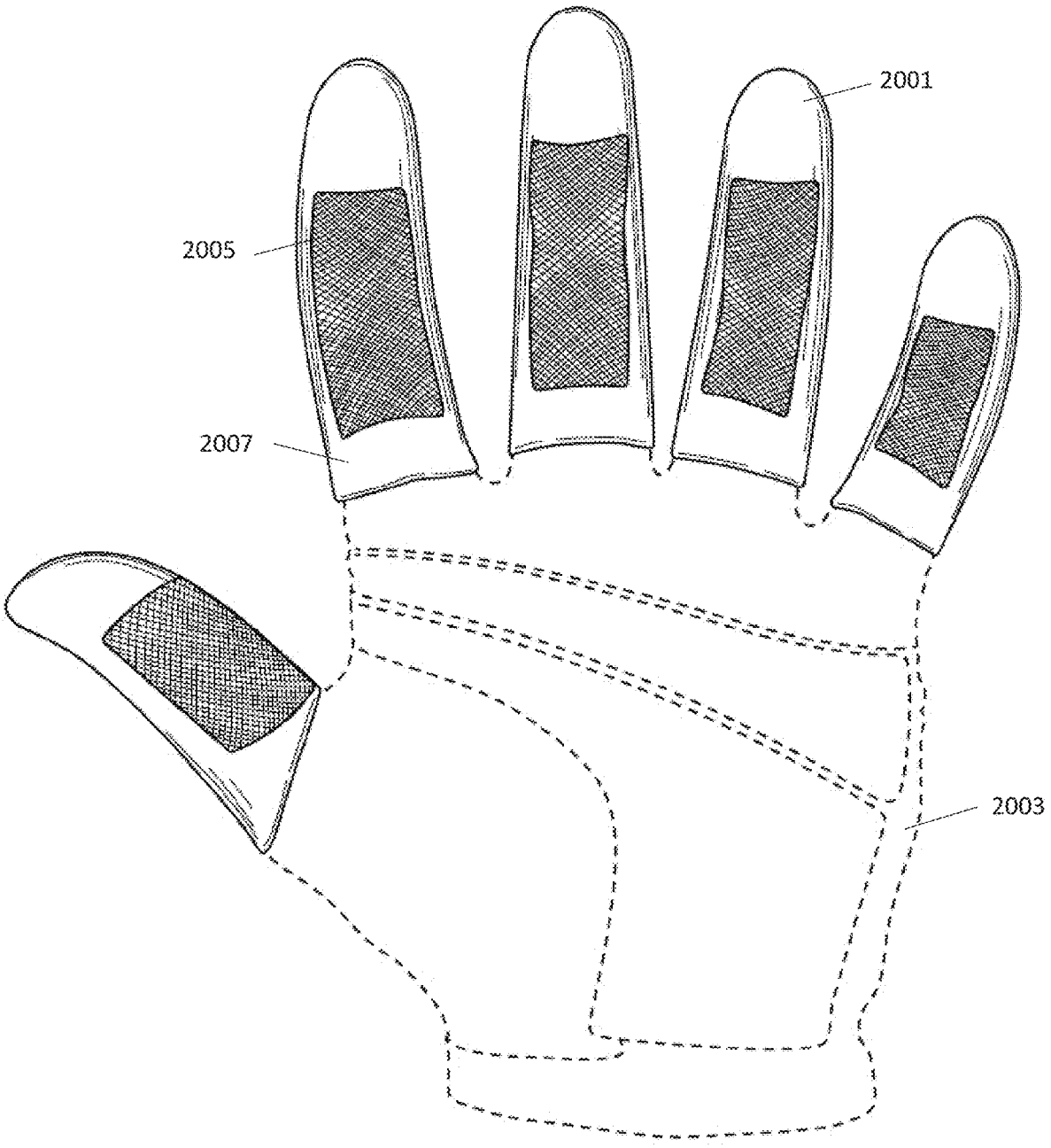
FIG. 20 illustrates a front view of full-finger sleeves with extended grip zones, wherein the full finger sleeves are combined with a glove according to one embodiment of the present invention.

FIG. 20 illustrates an embodiment of the current invention where the disclosed sleeves 2001 are worn over a snug fitting glove 2003. Furthermore, the sleeves extend past the intermediate and distal phalanges to cover the entire finger. A user may wish wear the sleeves over a glove in order to protect the rest of the hand, or in adverse weather conditions such as extreme cold, but still enhance their grip via friction. In this case, the glove limits bending of the fingers, and as such, the sleeve 2001 is adapted to have one, much larger grip zone 2005 in order to maximize grip enhancement in the given situation. This larger grip zone 2005 covers between 50% and 100% of the anterior side of the sleeve 2007. In another embodiment, the grip zone covers between 60% and 85% of the anterior side of the sleeve 2007. In another embodiment, the sleeves are integrated with the glove so as to not further increase the overall thickness of the gloves other than the increase due to the grip zone.

The above-mentioned examples are provided to serve the purpose of clarifying the aspects of the invention, and it will be apparent to one skilled in the art that they do not serve to limit the scope of the invention. By nature, this invention is highly adjustable, customizable and adaptable. The above-mentioned examples are just some of the many configurations that the mentioned components can take on. All modifications and improvements have been deleted herein for the sake of conciseness and readability but are properly within the scope of the present invention.

The invention claimed is:

1. A sleeve for improved control, grip, and performance, comprising:

a textile base layer, at least two external grip zones, at least one internal grip zone, and a spine;

wherein the textile base layer is seamless;

wherein the textile base layer is composed of a compressive material which is fitted to the skin;

wherein the at least two external grip zones are on an anterior side of the sleeve and are separated corresponding to the phalanges regions of a corresponding finger or thumb;

wherein a coefficient of friction of the at least two external grip zones is greater than a coefficient of friction of the textile base layer;

wherein the at least two external grip zones are separated such that at least one textile region of the sleeve between the at least two external grip zones is less rigid than the at least two external grip zones to promote bending at the at least one textile region of the sleeve;

wherein the at least one internal grip zone extends lengthwise along at least part of an internal surface of the sleeve;

wherein the at least one internal grip zone is configured to contact skin of a user;

wherein the spine is segmented to provide flexibility to the sleeve;

wherein the spine extends along a length of the sleeve;

wherein the sleeve is configured to cover the proximal phalanges region and the intermediate phalanges region of the corresponding finger or thumb; and wherein the spine is woven or knit into the textile base layer and is constructed of a segmented padding material.

2. The sleeve of claim 1, wherein a coefficient of friction of the at least one internal grip zone is greater than the coefficient of friction of the textile base layer.

3. The sleeve of claim 2, wherein the at least one internal grip zone further comprises a heating element including a chemically activated heating material.

4. The sleeve of claim 1, wherein at least one of the at least two external grip zones and the at least one internal grip zone are polygonal in shape.

5. The sleeve of claim 1, wherein the sleeve is woven or adhesively attached at both the distal and proximal ends of a phalangeal region of the sleeve to at least one second sleeve to form a multi-finger sleeve, wherein the multi-finger sleeve includes an outer surface, wherein the outer surface is flat and continuous, wherein the multi-finger sleeve further includes at least one grip zone.

6. The sleeve of claim 5, wherein the multi-finger sleeve includes a channel for inserting a support, wherein the support includes a rod.

7. A sleeve for improved control, grip and performance, comprising:

a textile base layer, at least one external grip zone, and a spine;

wherein the textile base layer is seamless;

wherein the textile base layer is composed of a compressive material which is fitted to the skin;

wherein a coefficient of friction of the at least one grip zone is greater than a coefficient of friction of the textile base layer;

wherein the at least one grip zone is integrated into the textile base layer;

wherein the at least one grip zone is polygonal in shape; and wherein the spine is woven or knit into the textile base layer of the sleeve, wherein the spine extends along a length of the sleeve, and wherein the spine is segmented to provide flexibility to the sleeve.

8. The sleeve of claim 7, further comprising a first internal grip zone and a second internal grip zone, wherein the first internal grip zone and the second internal grip zone are positioned symmetrically on a left and a right side of an internal face of the sleeve.

9. The sleeve of claim 8, wherein the first internal grip zone and the second internal grip zone extend along a length of the sleeve.

10. The sleeve of claim 7, wherein the spine extends between an intermediate proximal region of the sleeve to an intermediate distal region of the sleeve, wherein the spine is positioned to cover an area of the corresponding joint region, and wherein the spine is composed of a flexible, nonrigid material component.

11. A sleeve for improved control, grip, and performance, comprising:

a textile base layer, at least two internal grip zones, and at least one external grip zone;

wherein the textile base layer is cylindrical;

wherein the textile base layer is composed of a compressive material which is fitted to the skin;

wherein the at least one external grip zone is on an anterior side of the sleeve and is located corresponding to the phalanges region of a corresponding finger or thumb;

wherein a coefficient of friction of the at least one external grip zone is greater than a coefficient of friction of the textile base layer;

wherein the at least two internal grip zones and the at least one external grip zone are integrated into the textile base layer;

wherein the at least two internal grip zones are configured to contact skin of a user;

wherein the at least two internal grip zones and the at least one external grip zone are polygonal in shape; and wherein the sleeve is configured to cover the proximal phalanges region and the intermediate phalanges region.

12. The sleeve of claim 11, wherein the at least two internal grip zones extend along a length of the sleeve.

13. The sleeve of claim 11, wherein the textile base layer is seamless and is constructed from at least thermal reflective material, wherein the textile base layer further includes antimicrobial properties and/or infrared properties.

14. The sleeve of claim 11, further comprising a spine, wherein the spine is a folded or pleated textile material, and wherein the spine is constructed from a same textile material as the textile base layer, and wherein the spine is positioned on a posterior external side of the sleeve, wherein the at least one external grip zone is positioned on an anterior external side of the sleeve.

15. The sleeve of claim 14, wherein the spine covers between about 15% and about 50% of a surface area of the sleeve.

16. The sleeve of claim 11, further comprising two external grip zones, wherein the at least two external grip zones include a first external grip zone and a second external grip zone, wherein the first external grip zone extends horizontally across the intermediate phalangeal region of the sleeve, wherein the second external grip zone extends horizontally across the proximal phalangeal region of the sleeve.

17. The sleeve of claim 5, wherein the at least one grip zone of the multi-finger sleeve covers between about 60% and about 95% of a front face of the multi-finger sleeve and is constructed across the combined sleeves.

18. The sleeve of claim 11, further comprising at least one performance layer, wherein the at least one performance layer is placed in contact with the textile base layer and is further operable to be combined with at least one other performance layer to provide a single structure on the sleeve.

19. The sleeve of claim 18, wherein the at least one performance layer includes at least one material, wherein the at least one material includes an impact resistance material, a shock absorption material, a moisture-wicking material, and/or an antimicrobial material.

20. The sleeve of claim 11, wherein the at least two internal grip zones and the at least one external grip zone are substantially rectangular in shape.

* * * * *